US009561642B2

(12) United States Patent
Fuqua

(10) Patent No.: US 9,561,642 B2
(45) Date of Patent: Feb. 7, 2017

(54) SCREEN PRINTING MACHINE WITH EXTENDABLE AND RETRACTABLE PLATEN

(71) Applicant: Rick L. Fuqua, Indianapolis, IN (US)

(72) Inventor: Rick L. Fuqua, Indianapolis, IN (US)

( * ) Notice: Subject to any disclaimer, the term of this patent is extended or adjusted under 35 U.S.C. 154(b) by 10 days.

(21) Appl. No.: 14/592,967

(22) Filed: Jan. 9, 2015

(65) Prior Publication Data

US 2016/0200090 A1 Jul. 14, 2016

(51) Int. Cl.

| | |
|---|---|
| ***B41F 15/34*** | (2006.01) |
| ***B41M 1/12*** | (2006.01) |
| ***B41F 15/08*** | (2006.01) |
| ***B41F 17/00*** | (2006.01) |
| ***B41F 15/26*** | (2006.01) |
| ***B41F 17/38*** | (2006.01) |
| ***B41F 15/10*** | (2006.01) |
| ***B41F 15/12*** | (2006.01) |
| ***B41F 15/18*** | (2006.01) |
| ***B41F 15/36*** | (2006.01) |

(52) U.S. Cl.

CPC ..... *B41F 15/34* (2013.01); *B41F 15/08* (2013.01); *B41F 15/0836* (2013.01); *B41F 15/0863* (2013.01); *B41F 15/10* (2013.01); *B41F 15/12* (2013.01); *B41F 15/18* (2013.01); *B41F 15/26* (2013.01); *B41F 15/36* (2013.01); *B41F 17/003* (2013.01); *B41F 17/005* (2013.01); *B41F 17/38* (2013.01); *B41M 1/12* (2013.01); *B41P 2215/114* (2013.01)

(58) Field of Classification Search

CPC ..... B41F 15/08; B41F 15/10; B41F 15/12; B41F 15/18; B41F 15/26; B41F 15/34; B41F 15/36; B41F 15/0836; B41F 15/0863; B41F 17/003; B41F 17/005; B41F 17/38; B41M 1/12; B41P 2215/114

USPC ..... 101/114, 126, 129

See application file for complete search history.

(56) References Cited

U.S. PATENT DOCUMENTS

| | | | | |
|---|---|---|---|---|
| 4,315,461 | A * | 2/1982 | Harpold | B41F 15/04 101/115 |
| 4,407,195 | A | 10/1983 | Jaffa | |
| 4,735,139 | A | 4/1988 | Szarka | |
| 5,154,119 | A | 10/1992 | Fuqua et al. | |
| 5,163,651 | A * | 11/1992 | Matsumoto | B23Q 1/38 108/20 |
| 5,188,026 | A | 2/1993 | Fuqua et al. | |
| 5,188,034 | A | 2/1993 | Iaccino et al. | |
| D337,347 | S | 7/1993 | Motev et al. | |
| D337,348 | S | 7/1993 | Motev et al. | |
| 5,226,362 | A | 7/1993 | Iaccino et al. | |
| 5,228,108 | A | 7/1993 | Motev et al. | |
| 5,249,255 | A | 9/1993 | Fuqua et al. | |
| 5,309,831 | A | 5/1994 | Fuqua et al. | |
| 5,503,068 | A * | 4/1996 | Newman | B41F 15/16 101/126 |

(Continued)

*Primary Examiner* — Jill Culler
*Assistant Examiner* — Marissa Ferguson Samreth
(74) *Attorney, Agent, or Firm* — Woodard Emhardt Moriarty McNett and Henry LLP

(57) ABSTRACT

A screen printing system includes a screen printing machine. The screen printing machines includes a screen printing unit with a screen. A platen arm assembly includes a platen configured to move in a telescoping direction from at least a first position where the platen is positioned under the screen to a second position that is different from the first position.

27 Claims, 15 Drawing Sheets

(56) References Cited

U.S. PATENT DOCUMENTS

| | | | | |
|---|---|---|---|---|
| 5,575,206 | A | 11/1996 | Szyszko | |
| 5,592,877 | A | 1/1997 | Szyszko et al. | |
| 5,595,113 | A | 1/1997 | Daniel et al. | |
| 5,640,905 | A | 6/1997 | Szyszko et al. | |
| D384,039 | S | 9/1997 | Szyszko et al. | |
| D387,034 | S | 12/1997 | Szyszko et al. | |
| 5,787,805 | A | 8/1998 | Szyszko et al. | |
| 5,806,425 | A * | 9/1998 | Newman | B41F 15/10 101/127.1 |
| 5,809,877 | A | 9/1998 | Szyszko et al. | |
| 5,845,569 | A | 12/1998 | Tkacz et al. | |
| 5,881,641 | A | 3/1999 | Tkacz | |
| 6,152,030 | A | 11/2000 | Fuqua | |
| 2005/0155500 | A1 * | 7/2005 | Latos | B41F 15/0863 101/126 |
| 2011/0262659 | A1 * | 10/2011 | Domoto | B41M 7/009 427/558 |
| 2015/0210094 | A1 * | 7/2015 | Komiya | B41J 11/20 347/104 |

* cited by examiner

SCREEN PRINTING MACHINE WITH EXTENDABLE AND RETRACTABLE PLATEN

BACKGROUND

Screen printing has been a popular way of decorating shirts, textiles, and other garments in recent years. Over the years, designs have evolved to become quite complicated requiring many layers of inks to be deposited on the textile. Drying or setting the ink after printing is commonly referred to as "flashing" within the textile printing industry. Plastisol ink is the most widely used ink system in t-shirt printing. Water-based inks are occasionally used but far less frequently. While water-based inks dry through evaporation, which is hastened by heat and air movement, plastisol has no solvents contained in its formulation and therefore requires only that the ink deposit is elevated to 230° Fahrenheit (110° Celsius) in order to "gel" the ink. A gelled ink deposit is dry to the touch but lacks any durability that a finished cured ink provides. Fully fused or cured plastisol is stretchable and resists cracking when stretched, whereas partially gelled/cured plastisol cracks easily if stretched. Fully curing plastisol is typically not attempted during the printing process but rather only after the garment has finished the printing process and is removed from the press. During curing, the garment is usually placed onto a conveyor that travels through a heated tunnel or oven designed to allow for the extra processing time to elevate the garment all the way to a 325 degree Fahrenheit (163° Celsius) temperature without scorching the material. Scorching of the textile or garment happens more easily then when short processing times are attempted at very high temperatures of 1000° Fahrenheit (538° Celsius) or more.

The plastisol ink is flashed or gelled during various stages of the screen printing process to avoid a number of undesirable issues. For example, when pressure is applied from a squeegee for applying additional colors to the garment, ink from prior stations that has not been flashed or gelled has a tendency to lift off and is deposited on the bottom of the screen. This lifting off of the ink in turn creates a number of issues. For instance, having the ink lift off causes the design or image to have less ink such that the resulting color is lighter. The ink can also smear, and the size of the lines and dots forming the design or image can expand.

It is therefore desirable to flash the ink as many times as possible at various stations of the screen printing machine to avoid these as well as other issues. However, due to the cost and size of screen printing presses as well as the market demand for more and more colorful artwork on darker or even black shirts, it is often times very difficult to flash or gel as many colors as a printer would like in order to control all of these potential issues. For example, the darker a background is, the greater the ink deposit needs to be in order to block the muting effects of the background and provide color brilliance. However, there is a greater risk for other issues when more ink is deposited.

Since current flash or cure units take up the space of a print station, the flash units eliminate the ability to print in the same station as is used for printing a color. Consequently, the printer loses color capability every time a flash unit is added to the print sequence. To add some perspective, during the early years oft-shirt printing (around the 1980's), presses were made with a total of 6 or 8 stations. When two stations are eliminated for loading and unloading the t-shirts, the presses of that era were only able to apply 4 to 6 colors. This made printing difficult for any dark colored garments. Since that time every few years the number of stations offered by machine manufacturers has grown to where machines are available with up to 20 plus stations. However, printers still try to print on garments with normally no more than 3 flash units and 2 flash units is the industry average. So few flash units are able to be used with acceptable results because the absorbency of the substrates on which the design or image is printed. For example, typical t-shirt material is absorbent such that it tends to hold the ink deposit in place when the pressure of another screen and squeegee is applied on top of it. Other less absorbent substrates like paper or even fabrics, such as waterproof nylon, tend to not hold an ink in place during the pressure of another print cycle but instead allow the ink to smear and pick up onto the bottom of the screen. With this less absorbent substrate, the deposit of ink becomes lighter and lighter, thereby losing color intensity, print detail etc.

These printing challenges can be further exacerbated by using additional specialty inks, such as glitter, puff, or heavy athletic look inks, that may require a heavier than normal deposit. Understanding these printing difficulties, the printer is often challenged to figure out where compromises can be made, such as in image clarity, color density, or texture malformations, when a screen printing machine is only equipped with a limited number of flash units. While buying a bigger screen printing machine would allow the printer to have more flash units, in most cases a bigger press is not a practical option. First of all, bigger screen printing machines are very expensive and are typically outside the budget of most printers. In addition, such large printing machines have a larger footprint and therefore occupy a greater floor space which might not be available in a particular printer's facility. Moreover, print artists tend to design the art for a garment based on how many print stations a screen printing machine has and rarely considers the need for some of the stations to be used instead for flashing or drying. Since many print shops cannot afford the cost of these large screen printing machines and lack the size of a facility that it requires to house these large machines, they often have to turn work away.

One way to address this issue is to use a procedure often referred to as "revolving" which is described in U.S. Pat. No. 5,595,113 to Daniel et al. A traditional approach uses a continuous production cycle in which one shirt is placed on the machine as one shirt is taken off, normally every 4 to 5 seconds. With the revolving technique, the printing process is changed into a batch production cycle that may take up to 10 minutes in order to produce 12 shirts. In this work around, the printer takes advantage of the few flash cure stations available and runs the garment around or under the available flash station(s) multiple times in order to dry each of the colors needed for a particular design. Often, the garments travel around 2 to 3, even as many as 10 times around printing machines before that batch of shirts is finished. This revolving printing technique is very time consuming and prematurely wears down the printing machine by requiring it to rotate or revolve 2 to 3 times (or even 10 times) as much as compared to the traditional continuous production cycle for producing the same amount of shirts or other garments. Thus, there is a need for improvement in this field.

SUMMARY

The screen printing machine and process described and illustrated herein addresses the above-mentioned issues as well as other issues. The screen printing machine includes one or more telescoping platen arm assemblies that are able to extend and/or retract one or more platens at various stations along the machine. The telescoping platen arm assemblies can be incorporated into newly assembled screen printing machines or retrofitted to an existing machine. In one form, the telescoping platen arm assembly allows the platen to extend out beyond a print head or unit in the machine so that the printed design on the garment can be inspected while setting up the machine and/or allows for flashing at every station. In another form, the platen is retracted behind the print head for flashing. With this unique design, printers owning smaller presses are able to print and flash at every station, thereby giving the smaller press the same or even greater capabilities in many cases to that of much larger presses. While in some circumstances the cycle time may be increased, this printing process maintains a continuous production cycle while at the same time eliminates all the wear and tear to the screen printing machine associated with batch production cycles using the revolving technique.

With this ability to flash at the same print station by extending and retracting the platen, a color can be cycled back and reprinted at the same print station after flashing. Printers often use a second identical screen in another additional station in order to improve color intensity. The telescoping platen assembly reduces or even eliminates the need for second sets of screens for the same color, which in turn reduces costs for the printer. Additionally that station used for a second screen can now be used for an additional color in the design.

The inventor for the screen printing machines described herein previously developed an under the screen flash cure unit that is described U.S. Pat. No. 6,152,030 to Fuqua in which the flash cure unit was inserted under the screen but above the printing platen to allow printing and drying at the same station. However, such a unit needed to be very thin to fit into the space of about 1¾ inches (4.445 cm) which is the typical space provided by screen printing machine manufacturers to ensure that the screen, ink, and shirt are sufficiently separated before indexing to the next print station. However, with such a design, heat build-up was always a concern. It was found that the heat from the flash unit was very detrimental to the printing screen (i.e., the heat would melt it) because there was inadequate space for proper air circulation for cooling. The under screen flash cure unit employed high tech ceramic material, clever heat paths for air flow, and a large blower to address this heat build-up issue. While the commercial product worked quite well, it was discovered that the under screen flash cure unit required proper adjustments that seemed to be difficult for the average press operator. Moreover, it was discovered that heat or other damage to the machine could occur if the cycle time was too long.

It was also discovered that the screen printing head or unit tended to impede cooling because it inhibited air circulation to the flashed surface of the garment and tended to trap the heat. By having the platen move out from underneath the printing screen, the telescoping platen arm assembly reduces or even eliminates the heat build-up concerns because the platen is able to properly cool after each flashing stage. When positioned away from the screen, fans can directly blow air directly down onto the face of the platen (and flashed ink layer) rather than trying to blow air sideways across the platen. In one printing technique, the platen is positioned below the screen printing head during printing. Afterwards, the platen is extended out from underneath the printing screen, and the head of the flash unit is extended over the platen for flashing. After flashing, the flash head is retracted or otherwise removed while the platen remains extended. One or more fans then blow air down and/or around the platen to cool the garment and platen. After cooling, the platen can be then retracted back underneath the printing screen for additional printing by the same screen printing head (or not) and the flashing process can be repeated as many times as desired. Again, this ability to print and flash multiple times at the same print station can improve the richness of the color as well as eliminate the need for additional screens (and stations) for the same color.

This system also enhances the inspection of prints, such as on screen printing machines with low lift/clearance print heads. In one form, the platen is manually released and moved to a position away from the print head in order to inspect the print quality. To manually release the platen, the operator pulls on a handle attached to a cable, and the operator manually extends the pallet to expose the image on the product. After inspecting the image, the platen is manually returned to the print position when the inspection is completed. A sensor verifies the platen is latched in a locked position before the screen printing machine is allowed to index.

Aspect 1 concerns a screen printing system, comprising a screen printing machine including a screen printing unit including a screen, and a platen arm assembly including a platen configured to move in a telescoping direction from at least a first position where the platen is positioned under the screen to a second position that is different from the first position.

Aspect 2 concerns the system of any preceding aspect, wherein the screen printing machine is configured to index the platen in an indexing direction that is transverse to the telescoping direction.

Aspect 3 concerns the system of any preceding aspect, wherein the screen printing machine is configured to rotate the platen about a central axis; and the platen is configured to move in a radial direction relative to the central axis when moving in the telescoping direction.

Aspect 4 concerns the system of any preceding aspect, wherein the second position is located in the radial direction closer to the central axis than the first position.

Aspect 5 concerns the system of any preceding aspect, wherein the second position is located in the radial direction farther away from the central axis than the first position.

Aspect 6 concerns the system of any preceding aspect, wherein the platen is uncovered from the screen when at the second position.

Aspect 7 concerns the system of any preceding aspect, wherein the platen arm assembly further includes a locking mechanism configured to lock the platen in place along the telescoping direction.

Aspect 8 concerns the system of any preceding aspect, wherein the locking mechanism is configured to at least lock the platen at the first position to promote registry between the screen and the platen.

Aspect 9 concerns the system of any preceding aspect, wherein the platen arm assembly further includes a release device configured to release the locking mechanism to allow the platen to move in the telescoping direction.

Aspect 10 concerns the system of any preceding aspect, wherein the release device includes a manual release configured to allow an operator to manually release the locking mechanism.

Aspect 11 concerns the system of any preceding aspect, wherein the release device includes an automatic release configured to allow the screen printing machine to automatically release the locking mechanism.

Aspect 12 concerns the system of any preceding aspect, wherein the platen arm assembly includes a rail assembly coupling the platen to the screen printing machine; and the rail assembly is configured to facilitate movement of the platen in the telescoping direction.

Aspect 13 concerns the system of any preceding aspect, further comprising wherein the rail assembly includes a support rail secured to the screen printing machine, a platen rail secured to the platen, and one or more bearings disposed between the support rail and the platen rail to reduce friction between the support rail and the platen rail; and wherein the locking mechanism is configured to lock the platen rail with the support rail.

Aspect 14 concerns the system of any preceding aspect, further comprising an automatic actuator configured to automatically move the platen from the first position to the second position.

Aspect 15 concerns the system of any preceding aspect, wherein the screen printing machine further includes a locking mechanism configured to lock the platen in place, and an automatic release configured to unlock the locking mechanism when the automatic actuator moves the platen.

Aspect 16 concerns the system of any preceding aspect, further comprising a flash unit configured to flash the platen when at the second position.

Aspect 17 concerns the system of any preceding aspect, wherein the flash unit has a flash head configured to extend to cover at least part of the platen when at the second position.

Aspect 18 concerns the system of any preceding aspect, wherein the flash unit is positioned to cover at least part of the platen when at the second position.

Aspect 19 concerns a screen printing system, comprising a screen printing machine including at least two stations, a platen configured to index in an indexing direction between the stations, and wherein the platen is configured to move at least in a horizontal direction that is transverse to the indexing direction at one or more of the stations.

Aspect 20 concerns the system of any preceding aspect, wherein the screen printing machine is configured to rotate about an axis; the indexing direction includes a rotational direction about the axis; the platen is configured rotate in the rotational direction about the axis during indexing; and the horizontal direction includes a radial direction relative to the axis of the screen printing machine.

Aspect 21 concerns the system of any preceding aspect, wherein at least one of the stations includes a screen printing head; and the platen is configured to move to an inner radial position that is located radially inwards of the screen printing head.

Aspect 22 concerns the system of any preceding aspect, wherein at least one of the stations includes a screen printing head; and the platen is configured to move to an outer radial position that is located radially outwards of the screen printing head.

Aspect 23 concerns the system of any preceding aspect, further comprising a flash unit configured to flash the platen when at the outer radial position.

Aspect 24 concerns the system of any preceding aspect, wherein the screen printing machine includes an automatic actuator configured to extend the platen to the outer radial position.

Aspect 25 concerns a method, comprising indexing a platen in an indexing direction to a station in a screen printing machine; and moving the platen at the station in a horizontal direction that is transverse to the indexing direction.

Aspect 26 concerns the method of any preceding aspect, further comprising screen printing a layer of ink onto a substrate carried by the platen at the station.

Aspect 27 concerns the method of any preceding aspect, further comprising wherein the screen printing occurs before the moving; and flashing the layer of ink on the substrate after the moving.

Aspect 28 concerns the method of any preceding aspect, further comprising wherein a screen printing unit performs the screen printing; wherein the moving includes moving the platen to an uncovered position where the screen printing head does not cover the platen; and cooling the layer of ink after the flashing by blowing air onto the layer of ink while the platen is at the uncovered position.

Aspect 29 concerns the method of any preceding aspect, further comprising wherein a screen printing unit performs the screen printing; wherein the platen is located at a first position where the platen is covered by the screen printing head during the screen printing; wherein the moving includes moving the platen from the first position to a second position where the platen is not covered by the screen printing unit; wherein the flashing occurs when the platen is at the second position; moving the platen to the first position after the flashing; and screen printing a second layer of the ink onto the substrate with the screen printing head after the positioning.

Aspect 30 concerns the method of any preceding aspect, further comprising moving the platen to the second position after screen printing the second layer; and flashing the second layer of the ink while the platen is at the second position.

Aspect 31 concerns the method of any preceding aspect, further comprising wherein the screen printing occurs before the moving; and inspecting the layer of ink on the substrate after the moving.

Aspect 32 concerns the method of any preceding aspect, further comprising transferring a substrate to or from the platen after the moving.

Aspect 33 concerns the method any preceding aspect, wherein the moving takes the platen out of production.

Aspect 34 concerns the method of any preceding aspect, wherein the screen printing the second layer includes applying a printing pressure that is lower than during the screen printing the layer of the ink.

Aspect 35 concerns the system of any preceding aspect, further comprising a print unit positioned to print when the platen is positioned at the second position.

Aspect 36 concerns the system of any preceding aspect, wherein the print unit includes an individual screen print head machine.

Aspect 37 concerns the system of any preceding aspect, wherein the print unit includes a digital printer.

Aspect 38 concerns the system of any preceding aspect, further comprising a flash unit configured to flash the platen when at the inner radial position.

Further forms, objects, features, aspects, benefits, advantages, and embodiments of the present invention will become apparent from a detailed description and drawings provided herewith.

DETAILED DESCRIPTION

Figure 1:
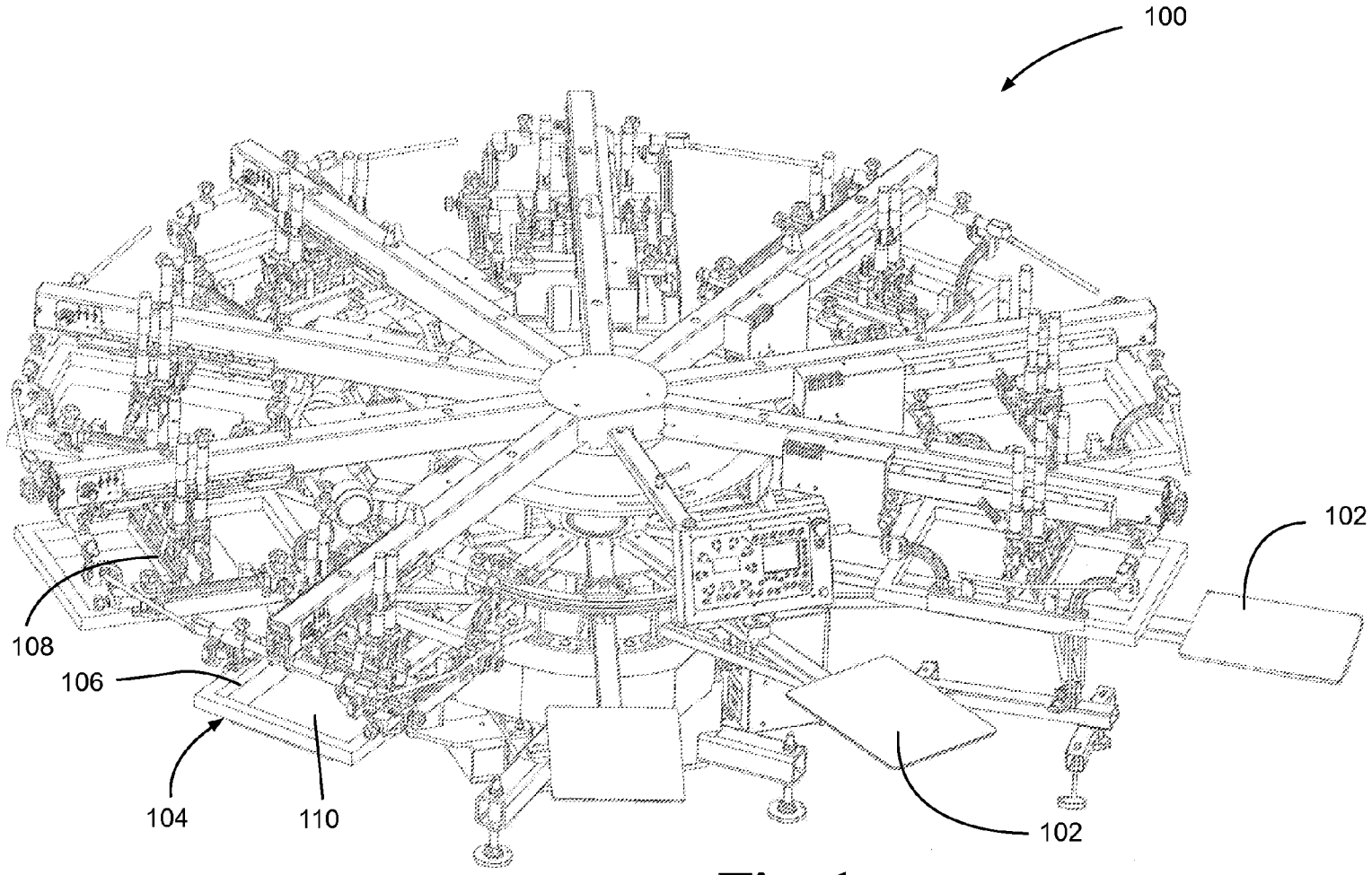
FIG. 1 is a perspective view of a screen printing machine that includes one or more extendable platens.

For the purpose of promoting an understanding of the principles of the invention, reference will now be made to the embodiments illustrated in the drawings and specific language will be used to describe the same. It will nevertheless be understood that no limitation of the scope of the invention is thereby intended. Any alterations and further modifications in the described embodiments, and any further applications of the principles of the invention as described herein are contemplated as would normally occur to one skilled in the art to which the invention relates. One embodiment of the invention is shown in great detail, although it will be apparent to those skilled in the relevant art that some features that are not relevant to the present invention may not be shown for the sake of clarity.

FIG. 1 shows a perspective view of one example of a screen printing machine 100 that incorporates one or more extendable/retractable platens 102. As shown, the screen printing machine 100 includes one or more stations 104 for performing the various screen printing activities. For example, the stations 104 can include screen printing units or heads 106 at which the screen printing ink is pressed via squeegees 108 through a screen 110 with a design so as to be applied onto a garment or other substrate such as a shirt. It should be recognized that the stations 104 can include other types of processing units used for screen printing, such as flash and/or drying units, or nothing at all such as where the garments are loaded and unloaded from the machine 100.

Figure 2:
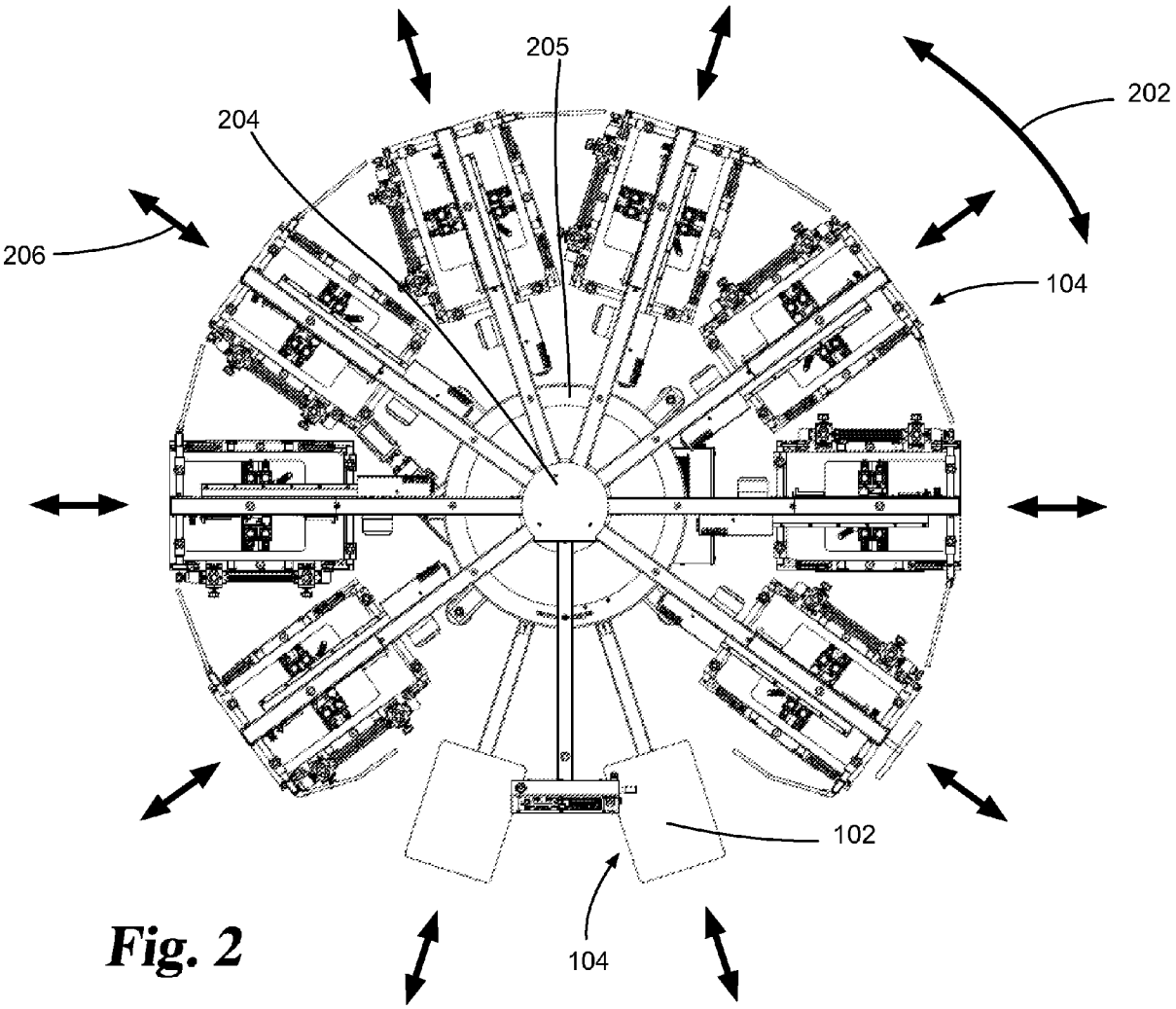
FIG. 2 is a top view of the FIG. 1 screen printing machine.

As indicated by double arrow 202 in FIG. 2, the platens 102 are indexed relative to the stations 104 by rotating about an axis 204. The screen printing machine 100 includes a central hub 205 to which the platens 102 are secured. The hub 205 rotates about the axis 204. Typically, the platens 102 are rotated in the same direction (e.g., clockwise) every time when indexed, but in certain situations, such as during maintenance, the platens 102 can be rotated in both directions (i.e., clockwise and counterclockwise) at different times. Most screen printing machines are normally indexed by rotation in a counterclockwise direction, but some machines are normally indexed in a clockwise direction. It is envisioned that the screen printing machine 100 can be normally indexed in either direction (e.g., clockwise or counterclockwise). In the illustrated example, the platens 102 are raised when indexed to the station 104 so that for example the garment is pressed against the screen 110 for printing purposes or for other printing operations. As indicated by double arrow 206, the platens 102 at one or more of the stations 104 (or in between the stations 104) can move horizontally in a radial direction relative to the axis 204 of rotation of the screen printing machine 100.

Figure 3:
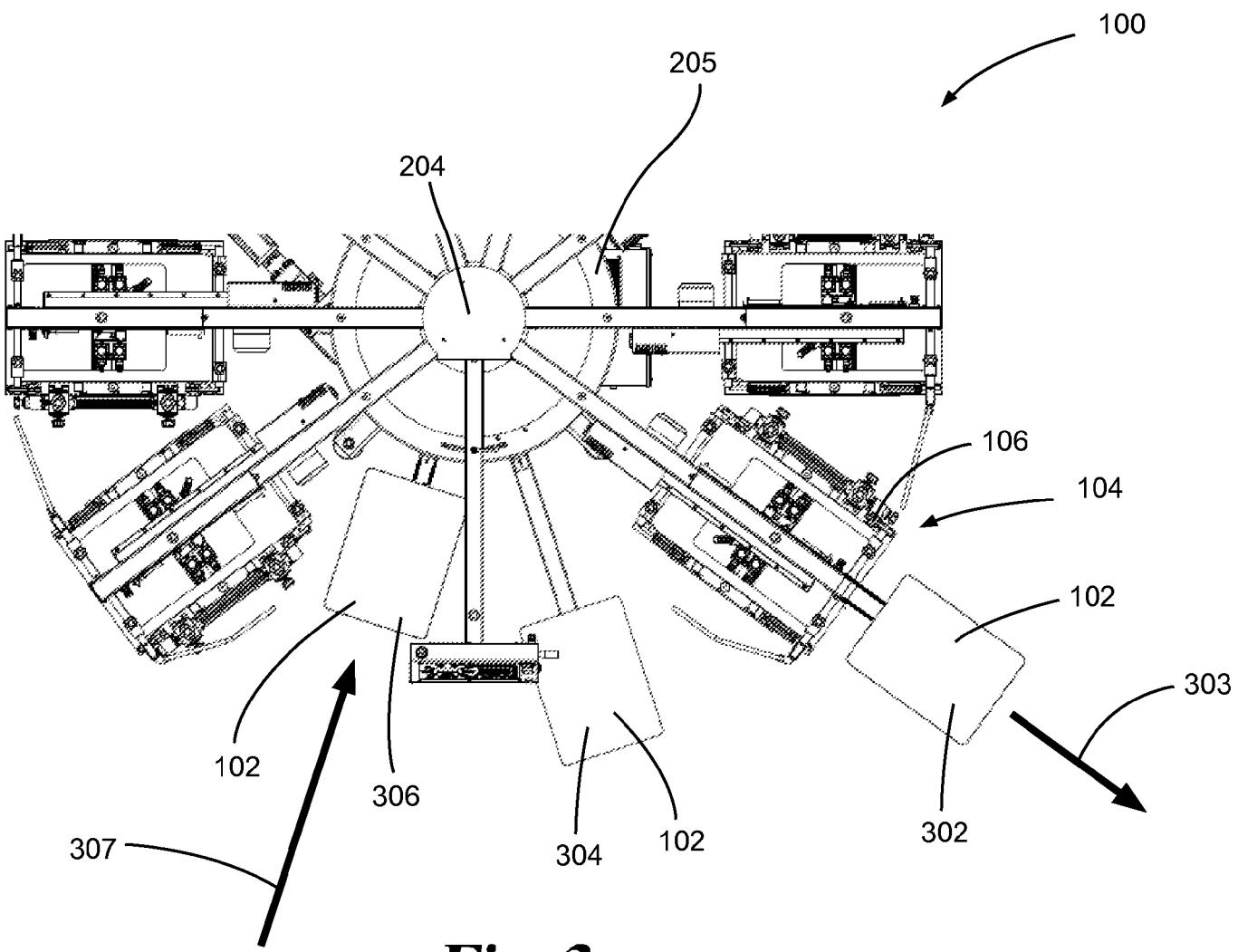
FIG. 3 is an enlarged top view of the FIG. 1 screen printing machine with platens in retracted, neutral, and extended positions.

FIG. 3 shows an enlarged top view of one version of the screen printing machine 100, and it shows the platens 102 at various radial orientations or positions at different stations 104. At station 302, the platen 102 is extended in an outer radial direction 303 to an extended position. The platen 102 can be extended manually and/or automatically. While at the extended position in station 302, various operations can be performed. For example, an operator can inspect the garment on the platen 102 for various quality issues, such as registration, color, etc., during setup and/or maintenance of the screen printing machine 100. Without this ability to radially extend the platen 102, the operator for previous screen printing machine designs had to index the platen 102 to an open position, such as at the unloading or loading stations, in order to inspect the garment. This both wasted time as well as increased wear on the screen printing machine, and made setup of the screen printing machine more difficult and/or time consuming Other activities or processes can occur when the platen 102 is at an extended (or retracted) position. For example, flocking of fabric, foiling (i.e., applying foil to the design), and/or other printing treatments, such as spraying random ink drop or blotch patterns, can occur when the platen is extended or retracted from the print head. In still yet another example, an additional layer of ink can be screen printed and/or a digital printing device can customize or personalize the garment (e.g., print a name, image, etc.) when the platen 102 is extended or retracted.

As will be explained in greater detail below, having the platen 102 in an extended position also allows other printing processes to occur without the need of eliminating screen printing units 106 from the screen printing machine 100. For instance, when at the extended position at station 302, the garment can be flashed and/or dried multiple times. In addition, having the platen 102 extended while at a loading or unloading station can improve ergonomics. For example, the platen 102 can be moved in the outer radial direction 303 so that the platen 102 is closer to the conveyor for a drying oven. The operator then does not have to perform a twisting motion to load the garment onto the drying oven conveyor. Moreover, the platen 102 can be configured to automatically retract so as to automatically remove the platen 102 from the garment, such as a shirt, during unloading, and the opposite can occur at the loading station; that is, the platen 102 can be for instance extended so as to facilitate insertion of the platen 102 into the shirt or other garment. Moreover, this telescoping or reciprocating ability of the platens 102 also allows loading and/or unloading activities to occur at stations 104 occupied by processing units, such as screen printing units 106 and/or flash units. For example, instead of having no processing equipment at a loading and/or unloading station, the station can include processing units, like screen printing units 106 and/or flash units, so as to increase the printing capabilities of the screen printing machine 100. In other words, each station 104 in the screen printing machine 100 can include screen printing units 106 or other processing units if so desired.

At station 304 in FIG. 3, the platen 102 is at a neutral or normal position where the platen 102 is aligned with the equipment, such as the screen printing units 106 (i.e., at a print position), at the various stations 104. Station 306 shows the platen 102 moved in an inner radial direction 307 to a retracted position. The platen 102 can be at the retracted position for any number of reasons. For example, the platen 102 can be retracted so that the particular platen 102 is out of service. Instead of having platens 102 of different sizes and/or configurations stacked off or otherwise removed from the screen printing machine 100, the platens 102 can be stored on the screen printing machine 100, but retracted away so as to not interfere with other printing processes. This facilitates quicker changeovers. In another example, the platen 102 is initially located at a retracted position at a loading station and then extended so as to be inserted into a garment for printing. In still yet another example, a flash unit is located at the retracted position so as to be radially inwards relative to the screen printing unit 106. After the screen printing unit 106 applies the ink to the garment, the platen 102 is retracted in the radially inwards direction 307 so that the platen 102 is located underneath the flash unit for flashing. It should be recognized that the platen 102 can be retracted for other reasons as well.

Figure 4:
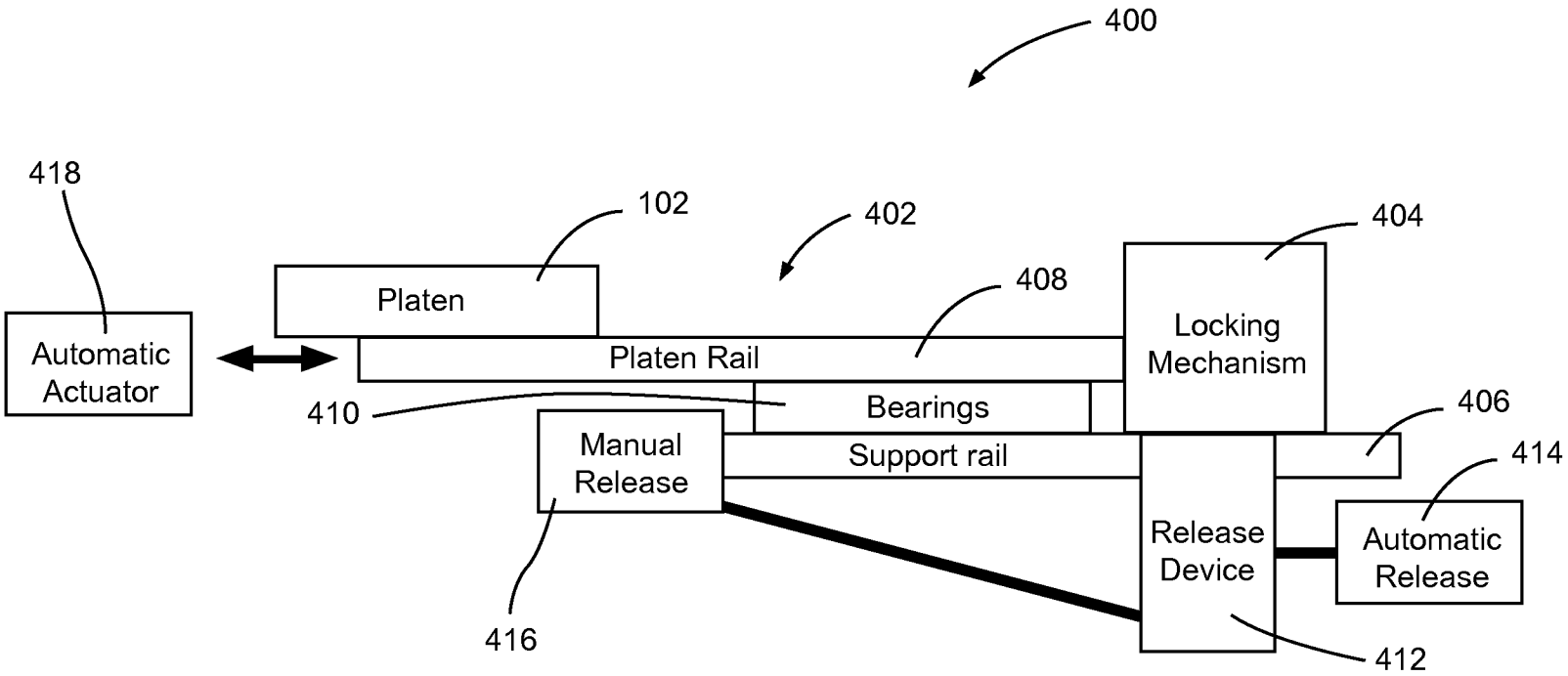
FIG. 4 is a block diagram of an arm assembly used in the FIG. 1 screen printing machine.

FIG. 4 shows a block diagram of one example of a platen arm assembly 400 used in the screen printing machine 100. As shown, the platen arm assembly 400 includes the platen 102, a rail assembly 402 supporting the platen 102, and a locking mechanism 404 that is configured to lock the platen 102 in one or more positions (e.g., extended, neutral, and/or retracted positions). The rail assembly 402 is secured to the hub 205 of the screen printing machine 100 in any number of manners, such as through bolts, welding, etc. As shown, the rail assembly 402 includes a support rail 406 that is secured to the hub 205 of the screen printing machine 100. The rail assembly 402 further includes a platen rail 408 to which the platen 102 is secured and one or more bearings 410 that facilitate smooth movement of the platen rail 408 relative to the support rail 406. In one particular form, the bearings 410 include two or more bearing rails upon which the platen rail 408 rides, but in other variations, other types of bearing systems for reducing friction between the platen rail 408 and the support rail 406 can be used. The locking mechanism 404 in the illustrated example is used to lock the position of the platen rail 408 relative to the support rail 406. In one example, the locking mechanism 404 is configured to lock the platen rail 408 in a single position, but it is contemplated that the locking mechanism 404 can be configured to lock the platen rail 408 in multiple discrete positions or even in a continuous basis. The locking mechanism 404 can ensure that the platen 102 is locked in the proper position for the various printing processes. During printing, if the platen 102 is not properly positioned, mis-registry can occur which in turn can reduce quality of the design printed on the garment or other material. The locking mechanism 404 is designed to ensure that the platen 104 is located at the proper position so as to reduce the risk of mis-registry as well as other issues affecting quality.

The platen arm assembly 400 further includes a release device 412 that is configured to release the locking mechanism 404 so as to allow movement of the platen rail 408 relative to the support rail 406. The release device 412 can be activated via an automatic release 414 and/or a manual release 416. The automatic release 414 allows the screen printing machine 100 to automatically actuate the locking mechanism 404, and the manual release 416 allows the operator to manually release the locking mechanism 404 so that the operator is able to manually extend or retract the platen 102. While both an automatic release 414 and manual release 416 are shown in FIG. 4, it should be recognized that the platen arm assembly 400 in other examples can include just one of these release mechanisms or both of these release mechanisms can be combined together to form a single unit. The manual release 416 in one form includes a manual handle that is pulled to release the locking mechanism 404, and in another form, the manual release 416 includes an electric button that is pressed to release the locking mechanism 404.

The platen arm assembly 400 further includes an automatic actuator 418 configured to automatically extend and/or retract the platen 102 in a telescoping direction. The automatic actuator 418 in one form includes a pneumatic and/or hydraulic piston that is configured to couple to the platen rail 408, and in another form, the automatic actuator 418 includes an electric screw type motor. The automatic actuator 418 in still yet another form includes a belt drive. In one example, the automatic actuator 418 includes drive systems commonly found in the squeegee system for print heads. The automatic actuator 418 in another variation includes a linear actuator that interacts with mechanical element(s) in the platen arm assembly 400. In another example, the automatic actuator 418 utilizes an open end synchronous belt and pulley system mounted on the platen arm assembly 400 with the ends attached to the platen rail 408 and a tooth side exposed in a downwards direction. A drive unit is positioned under the platen rail 408 so that a toothed pulley is engaged with the belt and the platen motion drive. In a further example, the automatic actuator 418 includes a vertical shaft attached to the support rail 406 and a pinion. The pinion engages a rack on the platen rail 408. The pinion is driven by a fixed electric or pneumatic motor. The automatic actuator 418 in other examples can include linear motors such as direct drive linear motors like those manufactured by Kollmorgen.

Figure 5:
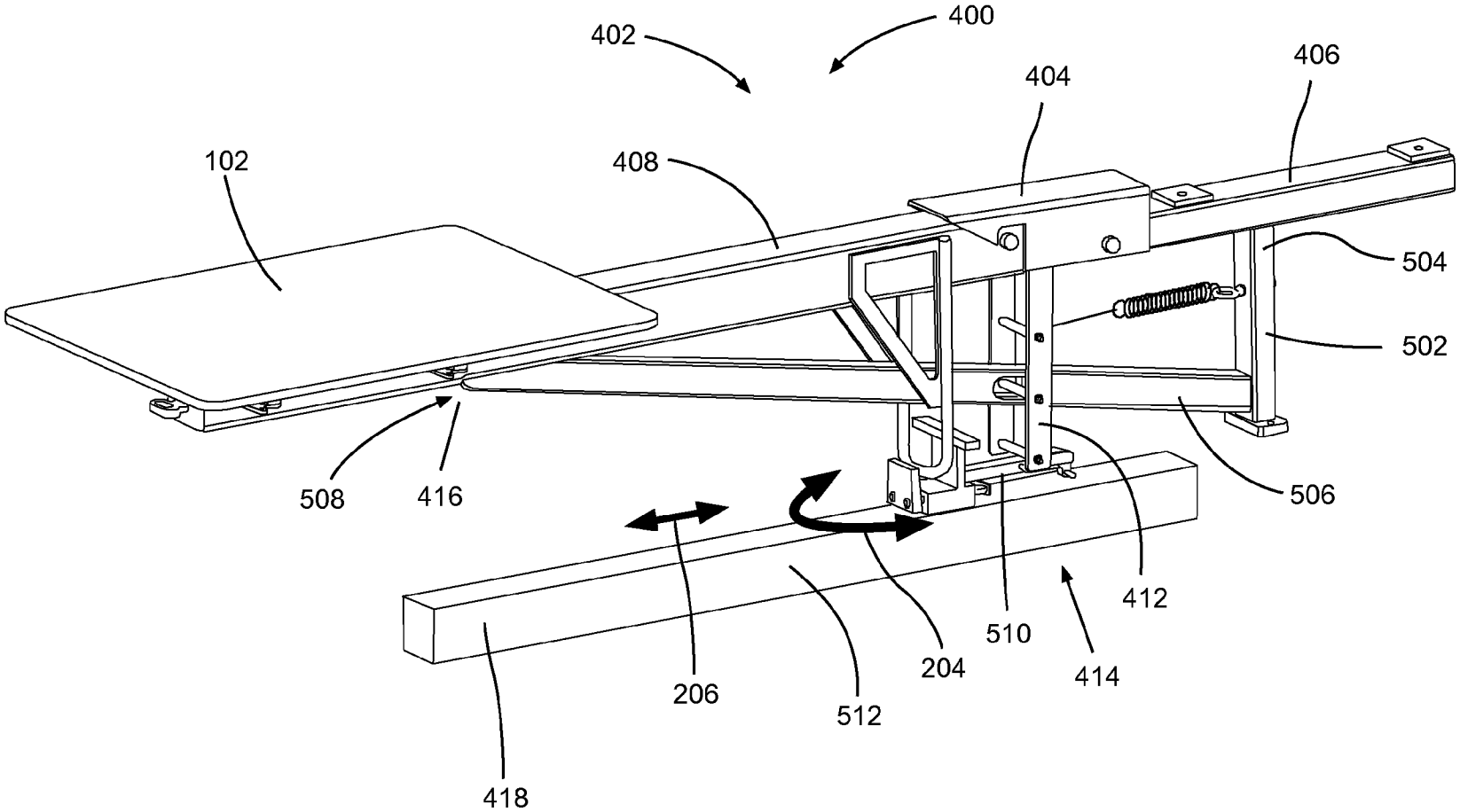
FIG. 5 is a perspective view of an arm assembly used in the FIG. 1 screen printing machine.

FIG. 5 shows a perspective view of one example of the platen arm assembly 400. The platen arm assembly 400 in FIG. 5 is configured to be retrofitted to existing screen printing machine designs, but it also can be incorporated into newly assembled screen printing machine designs. In the illustrated example, the support rail 406 includes a support frame 502 configured to support the support rail 406. The support frame 502 includes a support structure 504 along with a support brace 506. The support rail 406 along with the support structure 504 and the support brace 506 have a generally triangular shape, but it is envisioned that in other examples the support frame 502 can be shaped and/or configured differently. The platen rail 408 in the illustrated example has a U-shaped cross-sectional shape so as to receive the support rail 406. The platen rail 408 in the illustrated embodiment rides on top of the support rail 406, but it is contemplated that in other examples, the platen rail 408 can ride below or in other ways relative to the support rail 406. The manual release 416 in FIG. 5 is in the form of a pull handle 508 located at one end of the support brace 506 proximal to the platen 102. The operator pulls on the pull handle 508 so as to be able to manually extend the platen 102. The automatic release 414 in FIG. 5 includes a catch mechanism 510 that is secured to the automatic actuator 418. The automatic actuator 418 in the illustrated example includes an actuator member 512 that is coupled to a reciprocating piston. As indicated by the double arrow 206 in FIG. 5, the actuator member 512 of the automatic actuator 418 reciprocates in a linear manner During an extension stroke of the actuator member 512, the catch mechanism 510 releases the platen rail 408 so that the platen rail 408 is able to move along with the automatic actuator 418.

Figure 6:
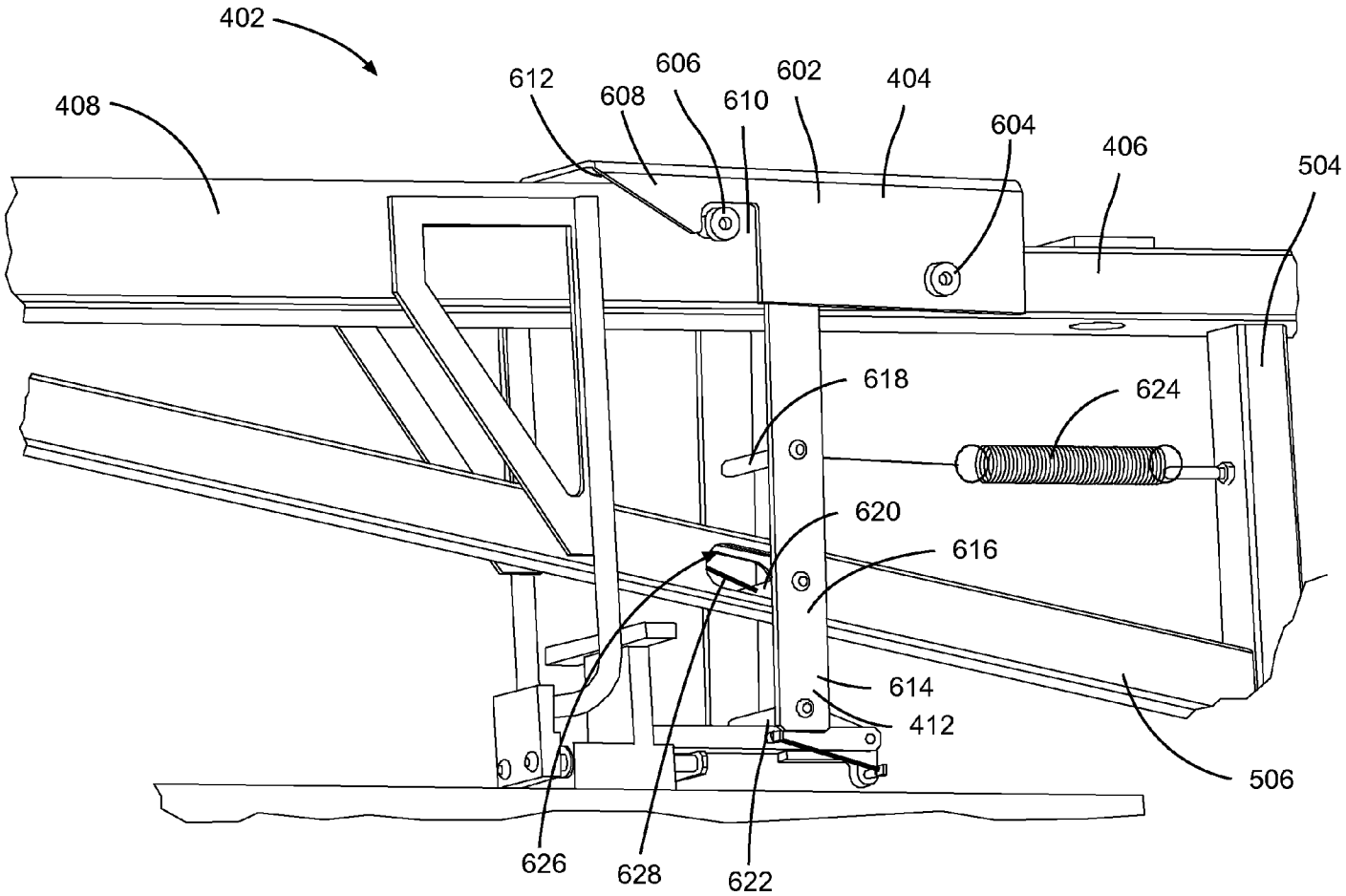
FIG. 6 is a front enlarged perspective view of the FIG. 5 arm assembly.

Turning to FIG. 6, the locking mechanism 404 includes a latch 602 that is pivotally coupled to the support rail 406 through a pivot pin 604. The latch 602 is configured to engage one or more engagement pins 606 on the platen rail 408. In the illustrated example, the engagement pins 606 extend on opposing sides of the platen rail 408, and the latch 602 is configured to engage the engagement pins 606 on both sides of the platen rail 408. The latch 602 and pins 604, 606 are configured in the same manner on both sides of the illustrated rail assembly 402. As shown, the latch 602 includes a hooked section 608 that defines one or more pin openings or notches 610 in which the engagement pins 606 are received. The latch 602 further includes a follower surface 612 on both sides of the rail assembly 402 that is angled or beveled. When the platen rail 408 is retracted, the engagement pin 606 rides along the follower surface 612 until the engagement pin 606 is latched inside the pin notch 610.

The release device 412 in the illustrated example includes a release arm 614 that is secured to the latch 602. As shown in FIG. 6, the release arm 614 includes a pair of arm members 616 joined together by a biasing 618, a manual release 620, and an automatic release 622 member or strut. A biasing device 624 is configured to bias the latch 602 into a latched position. The biasing device 624 in the illustrated example is a spring that is tensioned between the biasing strut 618 and the support strut 504. It is contemplated that in other variations different types of biasing devices 624, such as other types of springs, actuators, solenoids, etc., can be used to bias the latch 602. As illustrated, a manual release slot 626 is located in the support brace 506. A release cable 628 extends inside the support brace 506 and is attached to both the manual release strut 620 and the pull handle 508 (FIG. 5). By being located inside the support brace 506, the release cable 628 is protected from being accidentally snagged. When the operator pulls the pull handle 508, the release cable 628 of the manual release 416 pulls on the release arm 614 which in turn causes the latch 602 to rotate about the pivot pin 604 (e.g., in a clockwise direction in FIG. 6) so as to release the engagement pin 606 from the latch 602. Once the engagement pin 606 is disengaged from the latch 602, the operator is able to manually pull on the platen 102 so as to extend the platen 102. During extension, the bearings 410 allow the platen rail 408 to move relative to the support rail 406. Alternatively or additionally, the automatic actuator 418 (FIG. 4) can be used to extend the platen 102. To retract the platen 102 to its original position, the operator pushes the platen 102 towards the axis 204 of the screen printing machine 100. As the engagement pin 606 reaches the latch 602, the engagement pin 606 rides along the follower surface 612 until the engagement pin 606 is latched inside the pin notch 610 in the latch 602. The biasing device 624 ensures that the engagement pin 606 remains engaged with the latch 602. Again, the locking mechanism 404 helps to ensure consistent location of the platen 102 in the screen printing machine 100 which in turn helps to promote improved registry.

Figure 7:
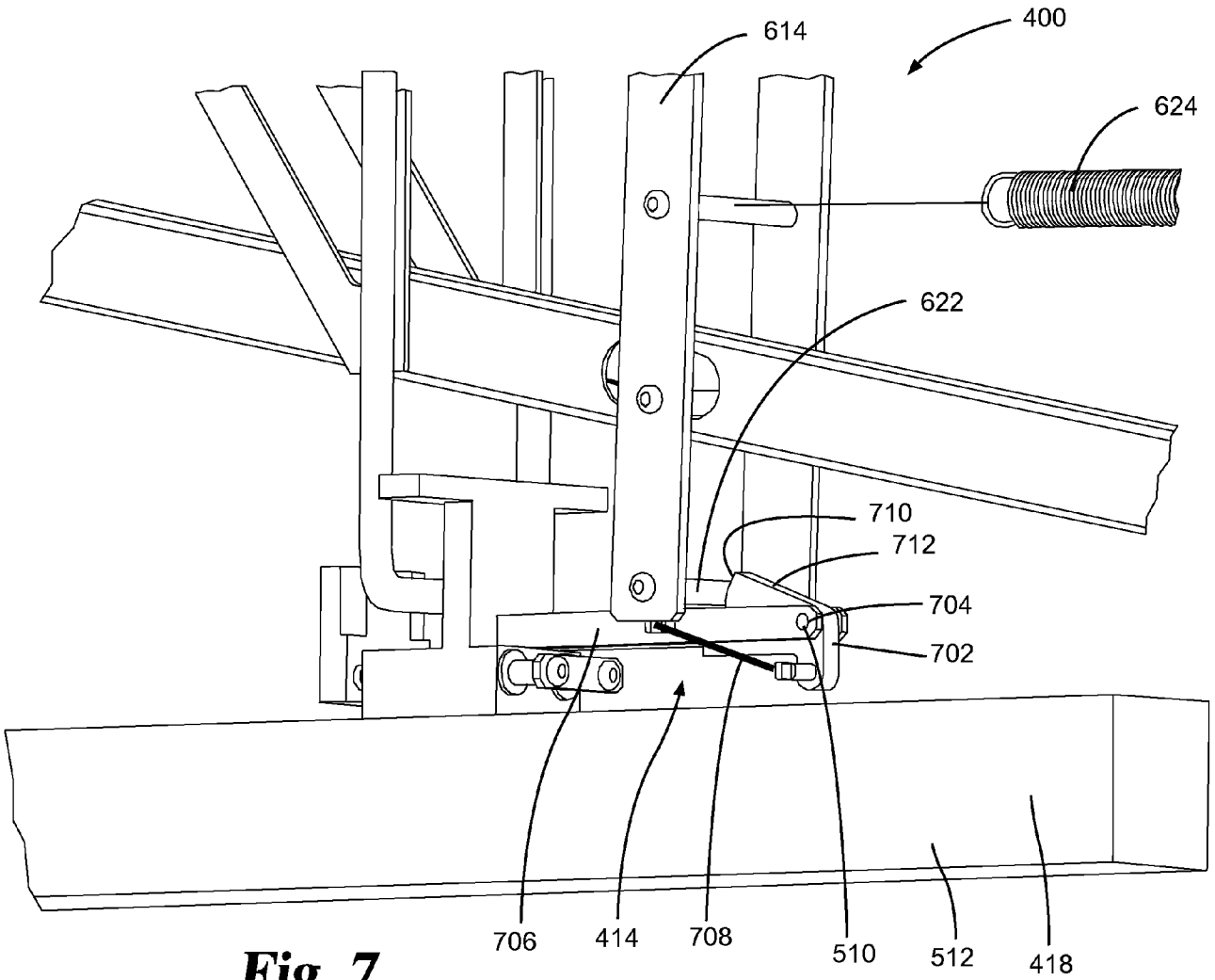
FIG. 7 is a rear enlarged perspective view of the FIG. 5 arm assembly.

FIG. 7 shows an enlarged perspective view of the automatic release 414 in the platen arm assembly 400. As noted before, the automatic release 414 includes the catch mechanism 510 that is configured to catch the automatic release strut 622 of the release arm 614. The catch mechanism 510 includes a catch member 702, a catch pin 704, and a catch arm 706. The catch member 702 is pivotally coupled to the catch arm 706 via the catch pin 704. A catch spring or biasing mechanism 708 biases the catch member 702 so as to engage the automatic release strut 622. When engaged, a strut engagement surface 710 of the catch member 702 contacts the automatic release strut 622. The strut engagement surface 710 in the illustrated example is slightly curved or beveled so as to facilitate further extension of the actuator member 512 once the latch 602 is released by allowing the automatic release strut 622 to slidably disengage from the catch member 702. The catch member 702 also has a strut follower surface 712 that is angled such that the automatic release strut 622 rides along the strut follower surface 712 during engagement of the catch mechanism 510 with the automatic release strut 622.

Looking at FIGS. 5, 6, and 7, in order to automatically release the latch 602, the automatic actuator 418 moves the actuator member 512 in an extension direction. As the actuator member 512 is extended, the catch member 702 via the automatic release strut 622 and the release arm 614 causes the latch 602 pivot about the pivot pin 604. This pivoting motion of the latch 602 causes the pivot pins 604 to be released from the latch 602, thereby releasing the platen rail 408 from the locking mechanism 404 such that the platen rail 408 is able to move. During retraction, the automatic release strut 622 rides along the strut follower surface 712 of the catch member 702 until the automatic release strut 622 reaches the strut engagement surface 710. At that point, the catch member 702 is then able to reengage the automatic release strut 602 so as to be able to release the platen rail 408 again when needed.

Figure 8:
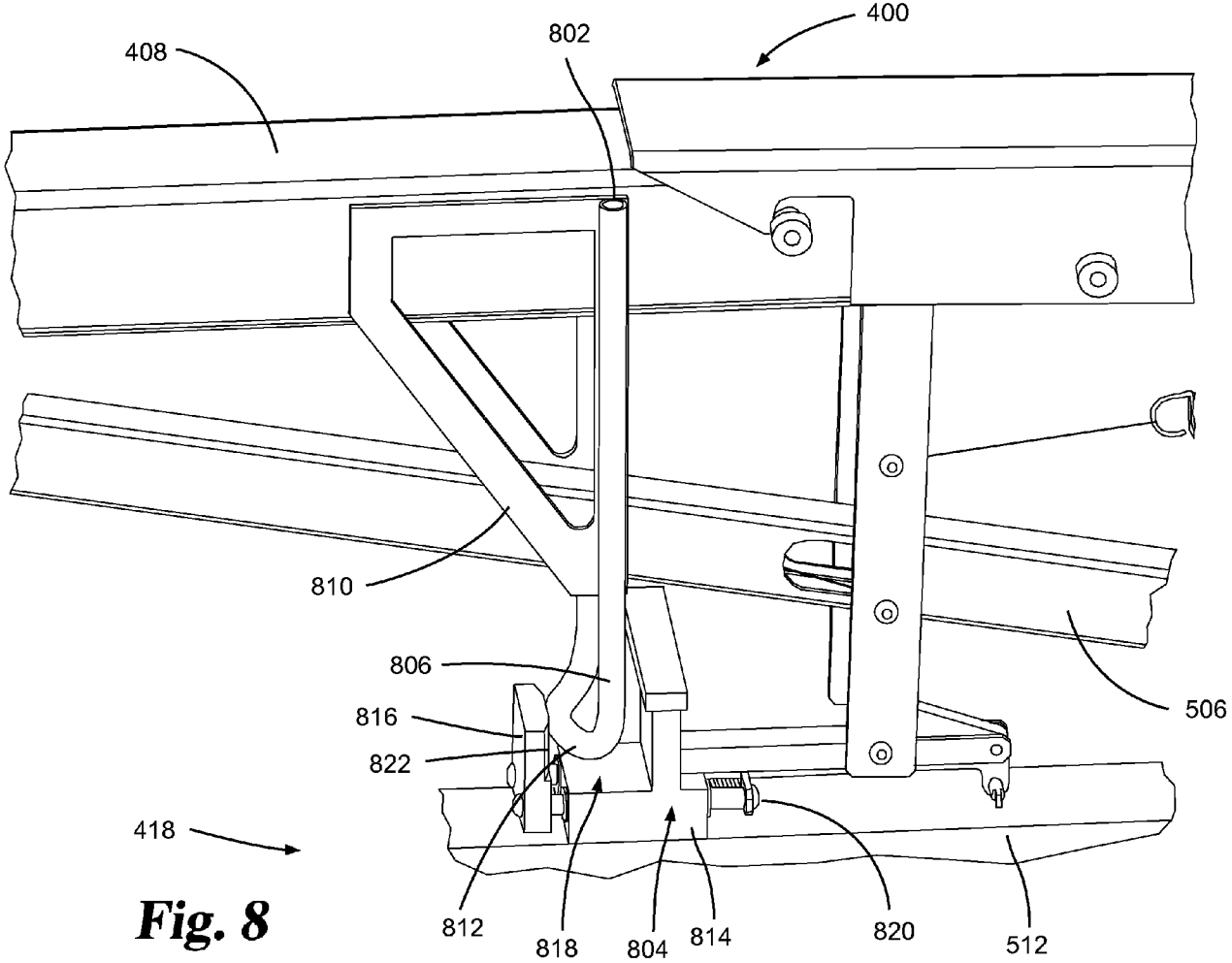
FIG. 8 is a top enlarged perspective view of the FIG. 5 arm assembly.

An enlarged perspective view of one example of the automatic actuator 418 is shown in FIG. 8. As illustrated, the automatic actuator 418 includes an extension arm 802 extending from the platen rail 408 and a coupling device 804 configured to couple the extension arm 802 to the actuator member 512. In the illustrated example, the extension arm 802 is secured in a fixed manner to the platen rail 408. The extension arm 802 includes a U-shaped engagement member 806 and a bracing structure 810 to support the engagement member 806 during actuation of the platen rail 408. The support brace 506 in the illustrated example extends through the engagement member 806 and has a buffer engagement section 812 configured to engage the coupling device 804. The buffer engagement section 812 in the illustrated example is beveled or arched to promote alignment of the extension arm 802 with the coupling device 804. The coupling device 804 includes a coupling member 814 and a buffer 816. The buffer 816 compensates for any variations in the location of the extension arm 802. If not compensated for, the extension arm 802 would tend to crash or otherwise damage the coupling device 804 as the platen arm assembly 400 is rotated in the screen printing machine 100. The coupling member 814 and buffer 816 define a coupling channel 818 in which the extension arm 802 is received. The buffer 816 includes a shock absorbing or compensation device 820, which in the illustrated example includes a pair of slidable guide rods and a compression spring, but it is contemplated that the shock absorbing device 820 can be configured differently in other examples. The buffer 816 further includes beveled surfaces 822 that are configured to engage and locate the buffer engagement section 812 of the extension arm 802.

Referring now to FIGS. 5, 7, and 8, the actuator member 512 remains at the same station 104 or location as the platen arm assembly 400 rotates, as is indicated by the double arrow 204 in FIG. 5. When the platen arm assembly 400 is rotated to a new station 104, the buffer engagement section 812 of the extension arm 802 is received inside the coupling channel 818 of the coupling device 804. With the beveled surfaces 822 of the buffer 816 and the arched shape of the buffer engagement section 812 of the extension arm, the extension arm 802 is properly located within the coupling channel 818 of the coupling device 804. Again, the shock absorbing device 820 compensates for any slight variations in the location of the extension arm 802 so as to avoid crashing or otherwise damaging the coupling device 804 and/or the extension arm 802. At the same time, the catch mechanism 510 is rotated into position so as to be able to engage the automatic release strut 622 of the release arm 614. To extend the platen 102 via the platen rail 408, the automatic actuator 418 moves the actuator member 512 in the direction for extending the platen 102, which in this example is an outer radial direction relative to the axis 204 of the screen printing machine 100 (FIG. 2). As the actuator member 512 extends, the catch member 702 of the catch mechanism 510 engages the automatic release strut 622 of the release arm 614. Turning to FIG. 6, further movement of the actuator member 512 causes the latch 600 to rotate about the pivot pin 604 so as to disengage from the engagement pin 606 on the platen rail 408. At the same time or shortly thereafter, the coupling member 814 pushes against the engagement member 806 so as to cause the platen rail 408 to move in the extension direction, which in turn causes the platen 102 to extend. Eventually, the catch mechanism 510 disengages from the automatic release strut 622. The platen 102 can continue to extend by further extending or moving the actuator member 512 until the platen 102 reaches the desired location. The coupling device 804 is configured to hold the platen 102 at any number of positions along the stroke length of the automatic actuator 418. In another variation, the platen 102 can have just two discrete radial positions, that is, an extended position and a retracted position.

When at the extended position, the garment on the platen 102 can be processed further and/or inspected. For example, the garment can be flashed when at the extended position and then retracted to its original position for additional screen printing. This printing-flashing-printing action can occur multiple times so as to improve the color and/or clarity of the printed image or design on the garment. To lock the platen 102 into its original position, the automatic actuator 418 moves the actuator member 512 in an inner radial direction. As the actuator member 512 moves inwardly, the coupling device 804 causes the extension arm 802 to retract. Eventually, the latch 602 re-engages the engagement pin 606, and the catch mechanism 510 re-engages the automatic release strut 622. The latch 602 secures the platen rail 408 in place which in turn ensures the proper registry of the platen 102. Once the platen is secured in place, the screen printing machine 100 can index the platen arm assembly 400 to the next station 104. It is envisioned that in other variations the platen 102 can be indexed while at an extended position.

Figure 9:
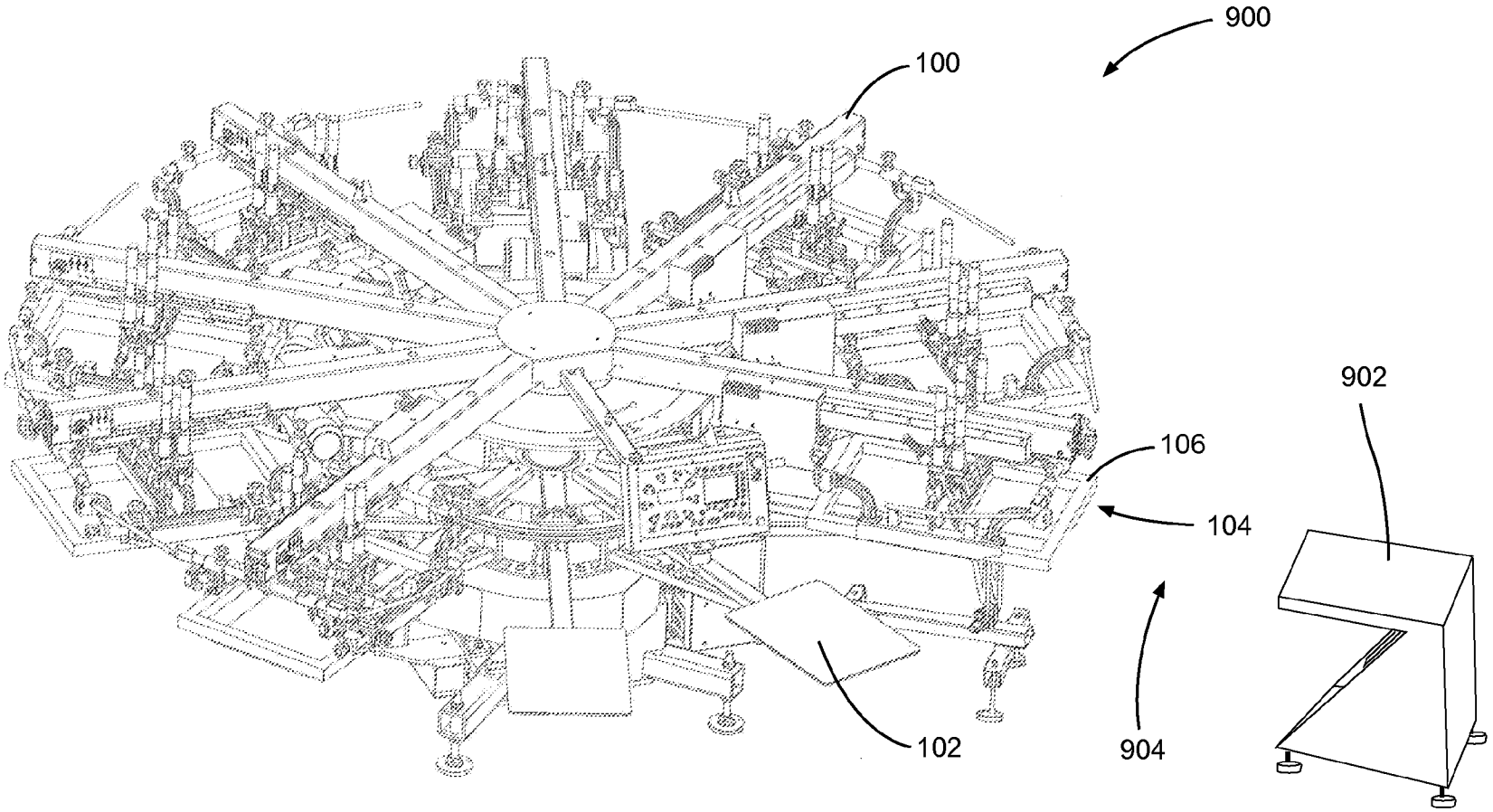
FIG. 9 is a perspective view of a screen printing system that includes the FIG. 1 screen printing machine along with a flash unit spaced away from the FIG. 1 screen printing machine to form a pathway.
Figure 10:
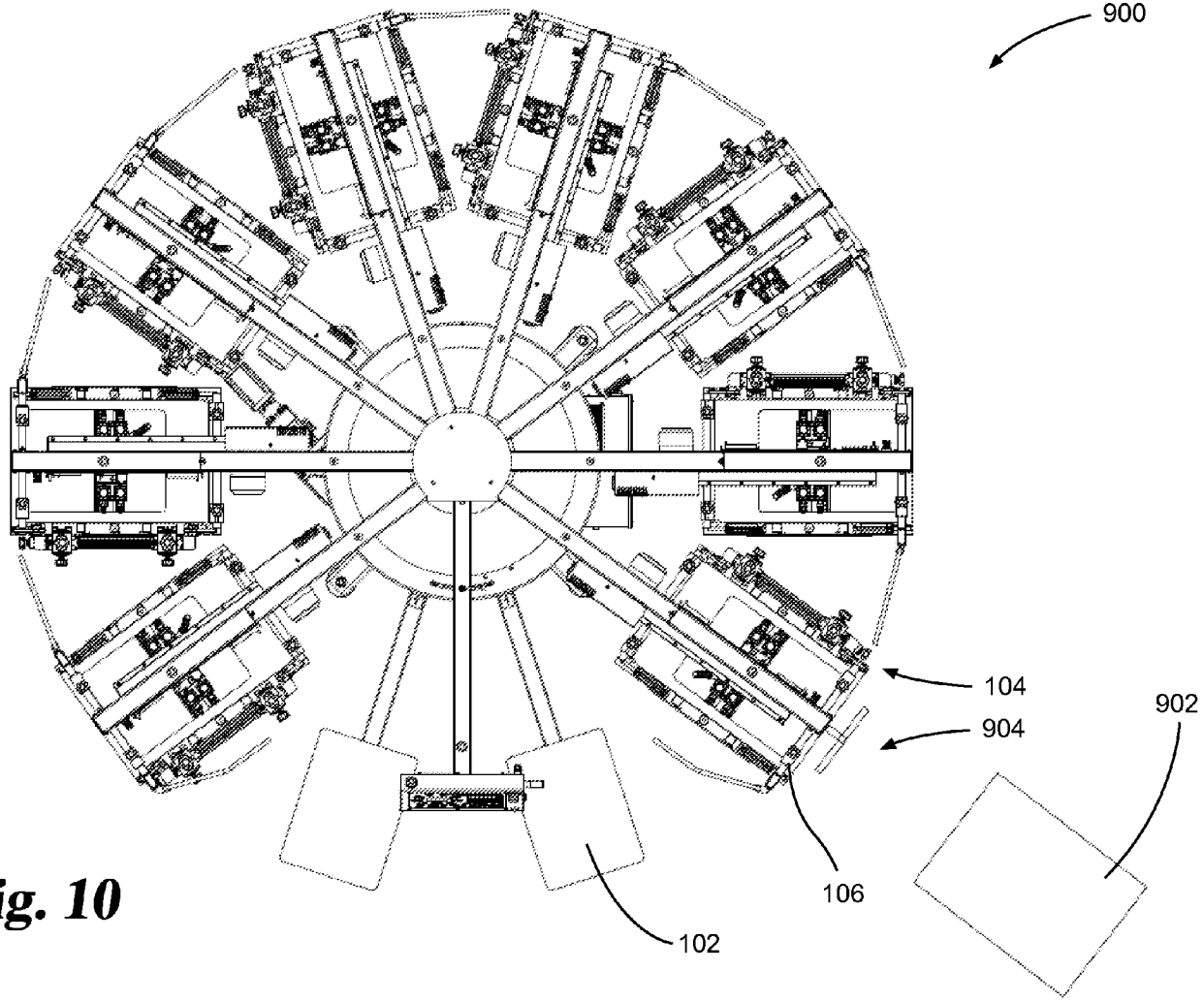
FIG. 10 is a top view of the FIG. 9 screen printing system.

A screen printing system 900 and a technique of operating the screen printing system 900 will now be described with reference to FIGS. 9, 10, 11, 12, and 13. While the technique will be described as to printing a design on a garment, such as a shirt, it should be recognized that this technique can be used to screen print designs on other types of materials and/or objects. As shown, the screen printing system 900 includes the screen printing machine 100 and a flash unit 902. While only a single flash unit 902 is shown in the drawings, it should be recognized that the screen printing system 900 can include more than one flash units at various stations 104 around the screen printing machine 100. Moreover, the flash unit 902 can be located at other stations 104 besides the station 104 depicted in the drawings. In one example, all of the stations 104 that include the screen printing units 106 (e.g., all stations except the loading and unloading stations) also have flash units 902. As illustrated in FIGS. 9 and 10, the flash unit 902 is spaced away from the screen printing machine 100 so as to form a gap or pathway 904. This pathway 904 allows an individual, such as a mechanic or operator, easy access around the screen printing machine 100. Moreover, this pathway 904 provides an area where an individual can visually inspect the print quality at the particular station 104 without being crowded by the flash unit 902.

Figure 11:
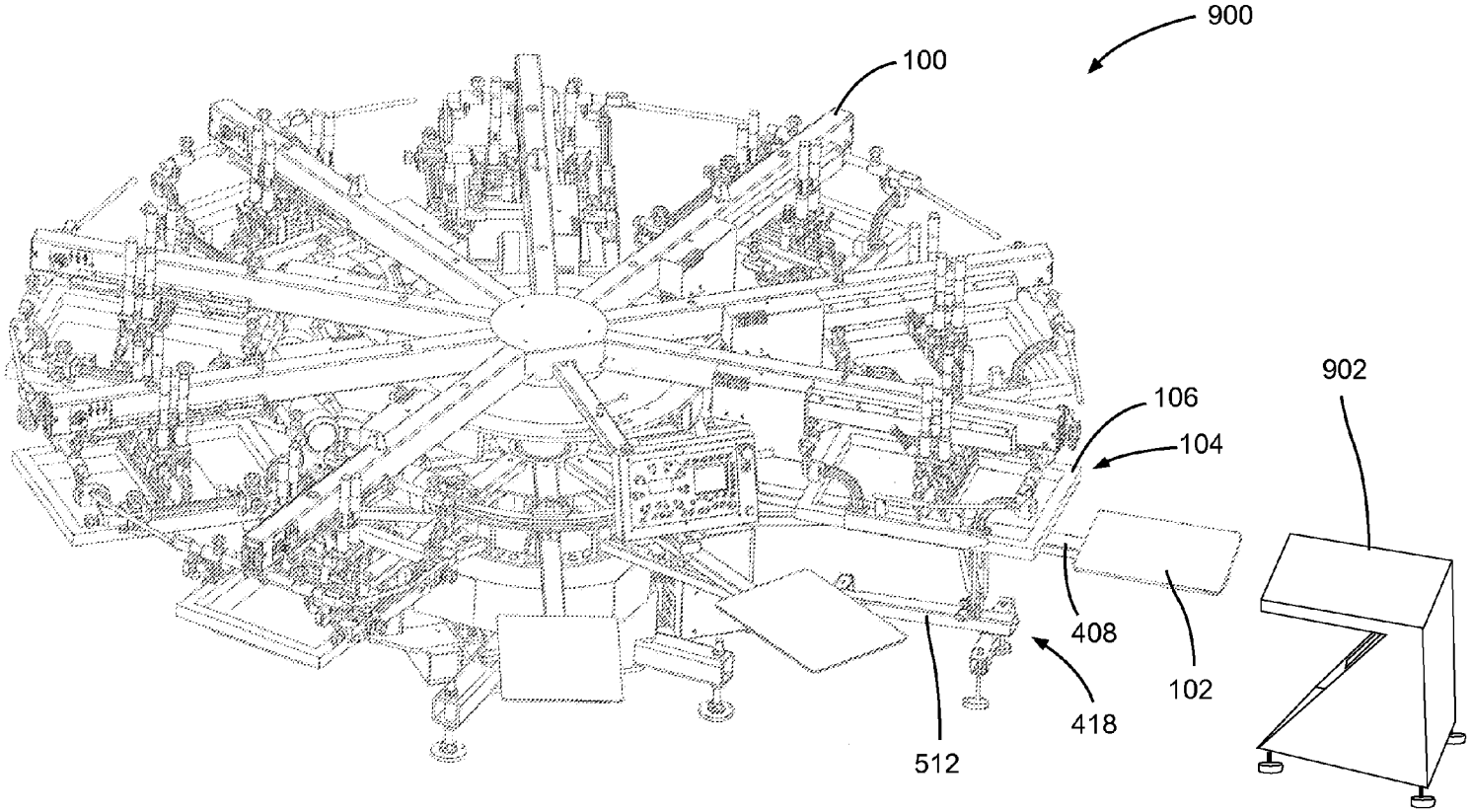
FIG. 11 is a perspective view of the FIG. 9 screen printing system with one platen extended at the station with the flash unit.
Figure 12:
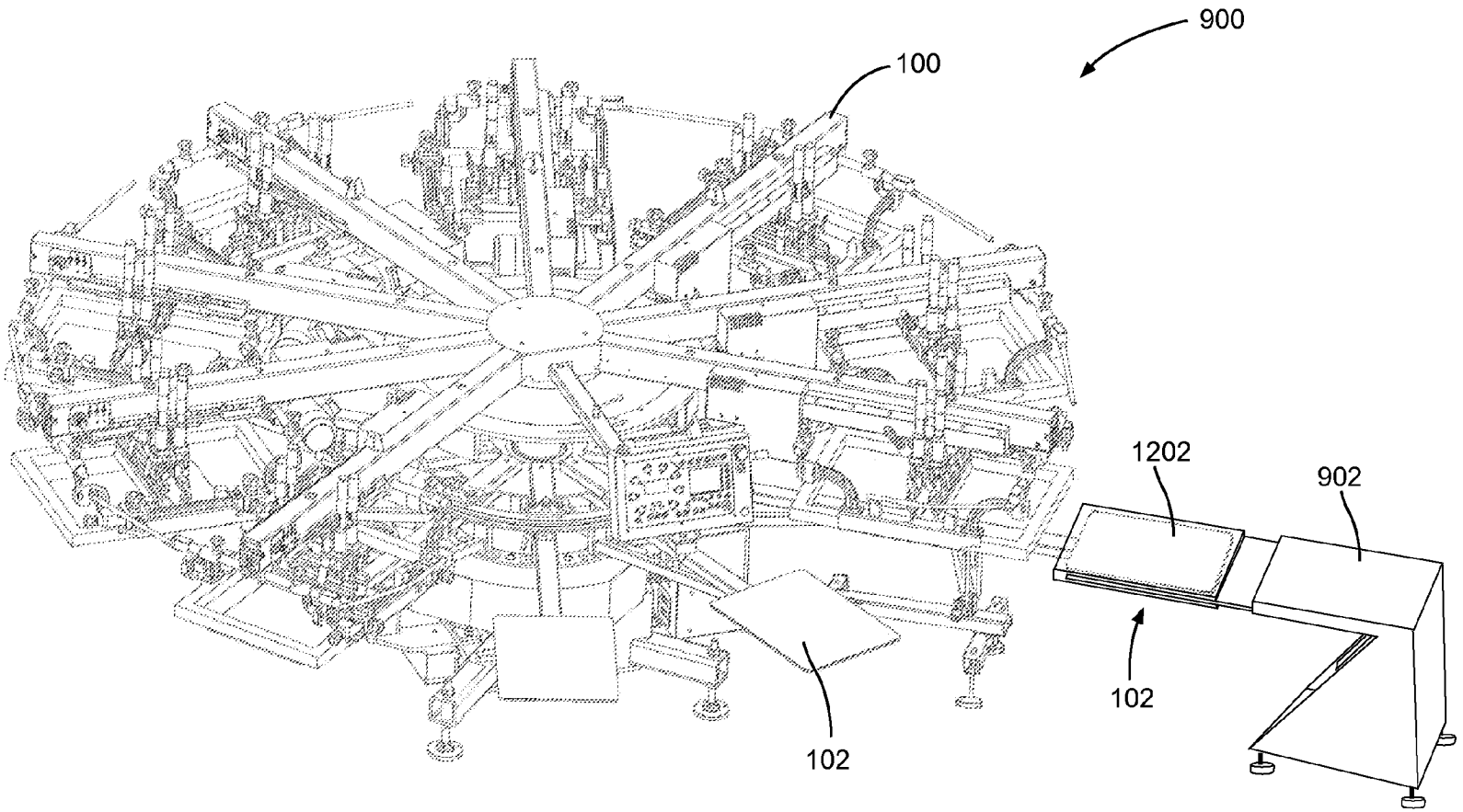
FIG. 12 is a perspective view of the FIG. 9 screen printing system with the flash unit in an extended state.
Figure 13:
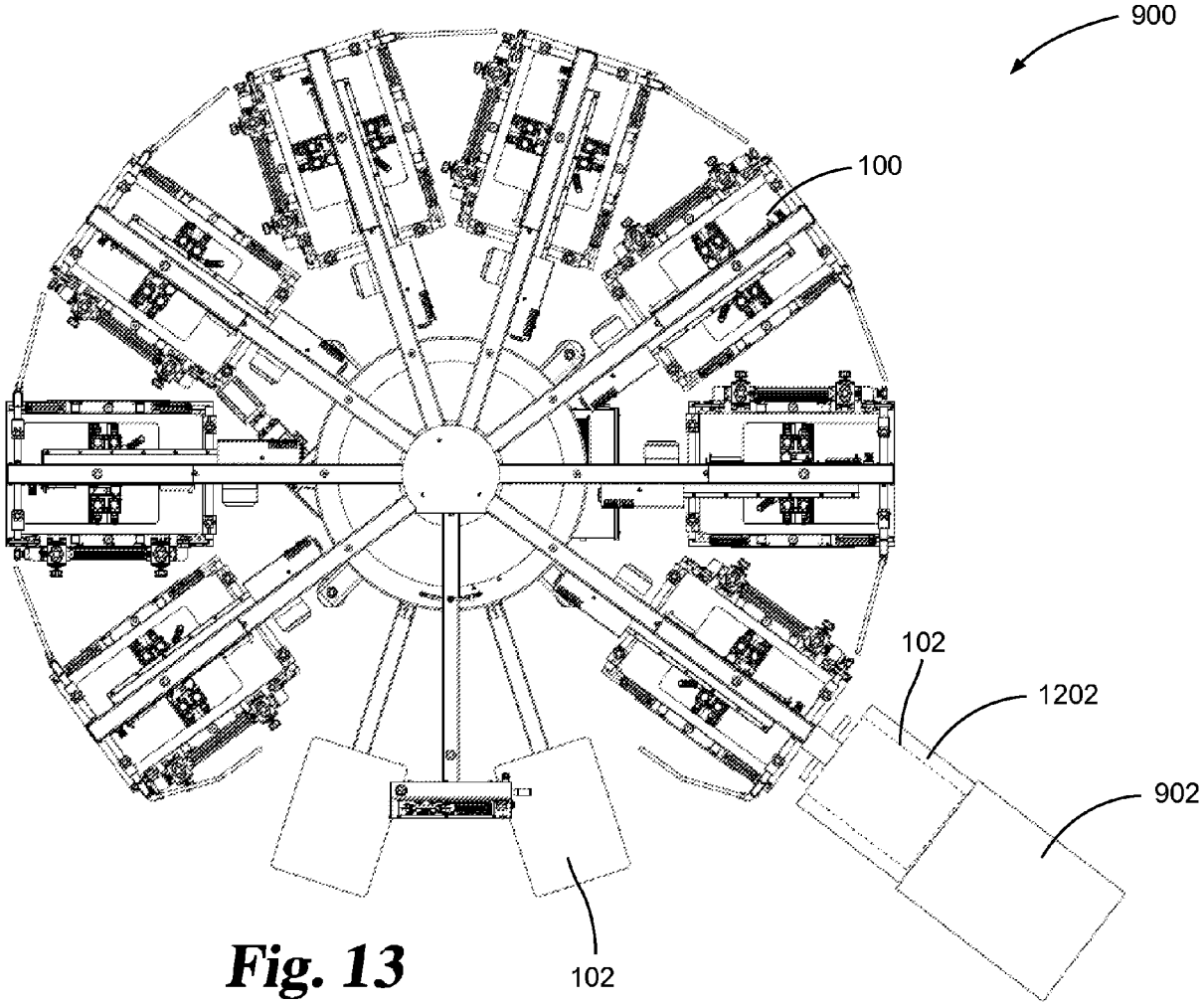
FIG. 13 is a top view of the FIG. 9 screen printing system with the flash unit in the extended state.

It should be recognized that the system 900 is configured to allow flash drying at the same position or station 104 as printing in the screen printing machine 100. To perform the printing, the platen 102 is indexed to the printing station. FIGS. 9 and 10 respectively show perspective and top views of the screen printing system 900 while the platen 102 is located at its print position. While at this position, the screen printing unit 106 screen prints a layer of ink on the garment or other substrate located on and/or around the platen 102. After the print cycle is complete, the platen 102 at the station 104 is lowered away from the screen printing unit 106 and extended to an extended position depicted in FIG. 11. It should be appreciated that the printing cycle might be repeated after a drying cycle. Specifically, after the printing cycle(s), the latch 602 is released in the manner as described before, and to extend the platen 102, the actuator member 512 of the automatic actuator 418 moves the platen rail 408 in the manner as described above with reference to FIGS. 4-8. It should be noted that the garment being printed upon is not illustrated in FIG. 11 so that the platen 102 is visible, and under normal operating conditions, the platen 102 would usually not be visible because the platen 102 would be covered or surrounded by the shirt or other garment. Before, during, or after the platen 102 is extended, a flash head 1202 is extended from the flash unit 902 such that the flash head 1202 fully or partially covers the platen 102, as is depicted in FIGS. 12 and 13. The flash unit 902 via the flash head 1202 flashes the garment on the platen 102. As mentioned before, flashing the ink on the garment enhances the printing quality. Alternatively or additionally, other external processes can occur when the platen is at the extended position. Additional layers of ink can be printed on top of the gelled layer which reduces the risk of the layer being peeled or otherwise damaged by additional screen printing. In the illustrated example, the flash head 1202 extends in an inner radial direction so as to cover the platen 102, but it should be appreciated that the flash unit 902 can be positioned at other locations and/or the flash head can extend in other directions so as to cover the platen 102. For instance, the flash unit 902 in one variation is positioned on either lateral side of the platen 102 (i.e., to the side of the station), and flash head 1202 at a direction generally parallel to the indexing direction of the screen printing machine 100.

Once the garment is flashed, the platen 102 and the flash head 1202 are simultaneously or sequentially (in any order) retracted to the positions illustrated in FIGS. 9 and 10. In one particular technique, the flash head 1202 is retracted while the platen 102 remains extended, such as is shown in FIG. 11. At that position, the platen 102 can be cooled, such as by being air cooled. Alternatively or additionally, one or more cooling fans blow air down and/or otherwise around the garment on the platen 102 to cool it. As noted before, having the platen 102 positioned out from underneath screen printing unit 106 (i.e., uncovered) enhances cooling of the garment on the platen 102. Afterwards, the platen 102 is retracted back underneath the screen printing unit 106 and latched into position by the latch 602. A sensor verifies that the platen 102 is properly locked into position so that the screen printing machine is free to index. At that point, the platen 102 can be indexed to the next station 104 or an additional layer of ink can be screen printed onto the garment via the screen printing unit 106. When an additional layer is screen printed onto the garment, the platen 102 can be re-extended in the manner as described above and the flash head 1202 of the flash unit 902 can reflash the garment so as to gel this additional layer of ink. This flash-print-flash process can be repeated to add even more layers of ink to the garment at the same station 104. This process or technique can be used to create richer colors or brighter designs on the garment. For example, when a dark or black shirt is printed with white ink, this flash-print-flash process when run multiple times can create brighter whites on the shirt without requiring additional stations 104. With this flash-print-flash capability, the screen printing pressures applied by the squeegee 108 can vary during each printing cycle. When ink is initially applied to a garment, high pressure is typically used to apply the ink because the garment acts like a wick and soaks up additional ink. However, after flashing, less pressure needs to be applied because the flashed layer is less absorbent than the fabric. The print quality can be detrimentally impacted by the extra ink applied if the same print pressure is used after flashing. In one particular print-flash-print technique, the squeegee 108 for the same print head 106 applies lower pressure to print a second layer of ink (or even more layers) after flashing as compared to the higher pressure used to apply the first or initial layer of ink to the garment or other substrate.

Figure 14:
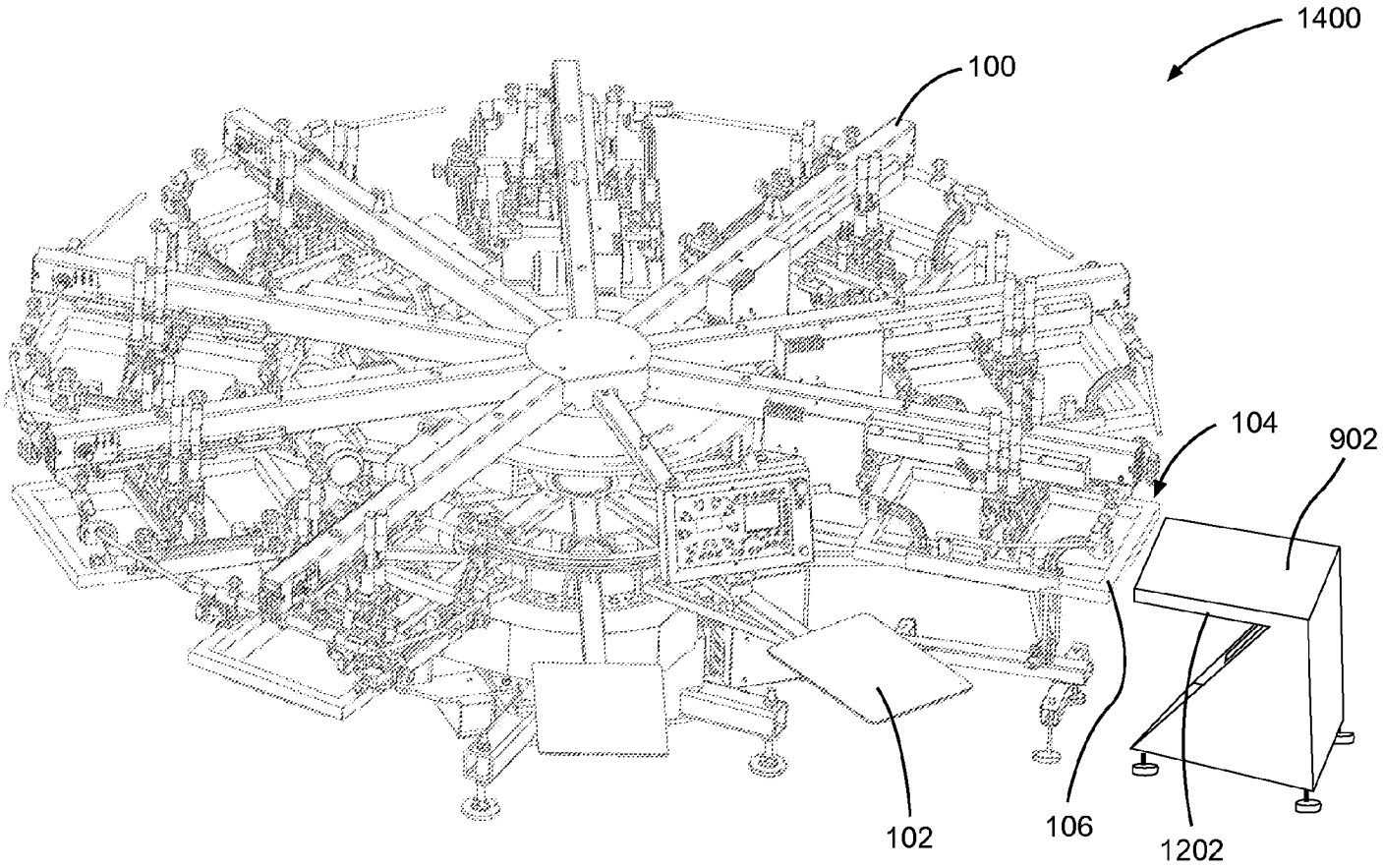
FIG. 14 is a perspective view of another example of a screen printing system in which the flash unit is positioned in close proximity to the outer periphery of the FIG. 1 screen printing machine.

FIG. 14 illustrates a perspective view of another example of a screen printing system 1400 that includes the screen printing machine 100 and the flash unit 902. In this example, there is no pathway or gap between the screen printing unit 106 and the flash unit 902 at the station 104. The flash unit 902 abuts almost generally against the screen printing machine 100 with a tiny clearance in between. In one example, the platen 102 is extended directly underneath the flash unit 902 after a layer of ink is printed onto the garment. In other words, the flash head 1202 of the flash unit 902 is not extended in order to flash the garment. In one variation, the platen 102 is raised after being extended so as to be placed in close proximity to the flash unit 902, and after flashing, the platen 102 is lowered away from the flash unit to create a space above the platen 102 for promoting cooling. Alternatively or additionally, one or more fans can blow air onto the platen 102 for cooling the flashed garment. In another variation, the platen 102 is not raised towards the flash unit 902 after being extended. In still yet another variation, the flash unit 902 is positioned so as to have the platen 102 extend radially outward past or through flash unit 902 and have the flash head 1202 extend radially outwards to cover the platen 102 for flashing.

Figure 15:
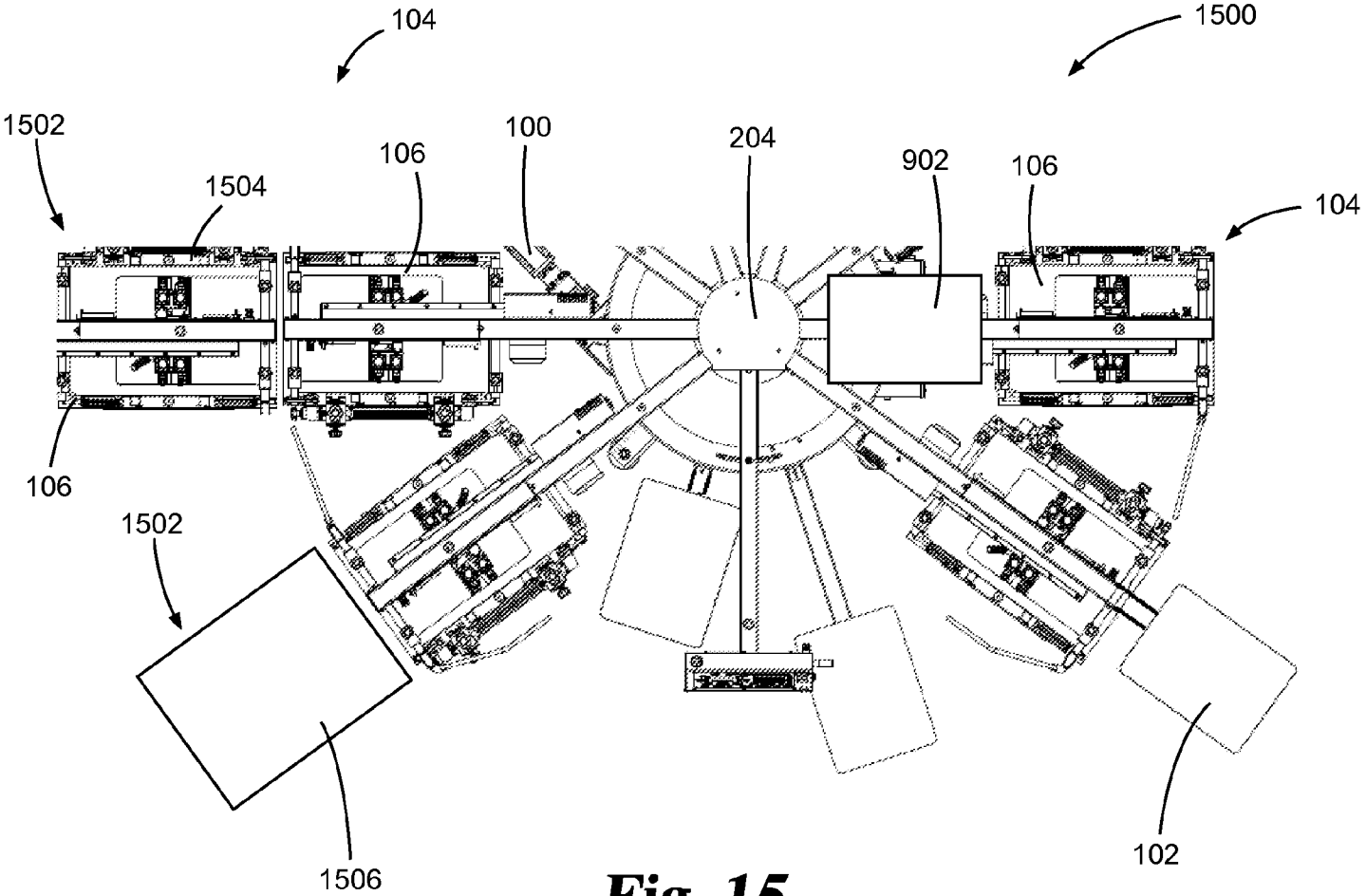
FIG. 15 is an enlarged top view of a screen printing system that includes a radially inwards located flash unit and additional printing units located around the outside of the FIG. 1 screen printing machine.

As mentioned before, this retractable or telescoping platen 102 allows other types of processing units to be added to, removed from, and/or relocated within the screen printing machine 100 to enhance its capabilities and provide greater process flexibility. FIG. 15 illustrates one example of a screen printing system 1500 that incorporates additional processing components. As can be seen, the screen printing machine 100 at one of the stations 104 has a flash unit 902 located radially inside of the printing head 106. This location frees up floor space as well as allows other processing units to be located at the same station 104 around the outer periphery of the screen printing machine 100. To flash the garment after screen printing with the printing head 106, the platen 102 is retracted radially inwards toward the axis 204 of the screen printing machine 100. Again, the same station 104 can perform multiple print-flash operations.

The system 1500 further includes one or more external printing units 1502 that enhance the printing capabilities and/or capacities of the screen printing machine 100. These printing units 1502 for example can be used to print additional layers of the same color, additional colors, additional designs, and/or facilitate customization of the printed item. As shown, the printing units are disposed at one or more stations 104 around the outer periphery of the screen printing machine 100. The printing units 1502 are positioned to print on the garments or other substrates when the platen 102 is in an extended position. If desired or needed, these printing units 1502 can be readily moved to other stations 104 within the same screen printing machine 100 or even to other different screen printing machines 100. With this system 1500, the capabilities of an existing screen printing machine 100 can be expanded in a gradual and financially safe manner. In other words, the owner does not need to incur the tremendous expense of buying a whole new screen printing machine in order to increase the number of printing stations.

The printing units 1502 can use any number of printing processes or techniques in order to print. In the illustrated example, one of the printing units 1502 is a single or individual station screen print head machine 1504 that incorporates a screen printing head 106 capable of screen printing a design onto the garment. The individual screen print head machine 1504 can print the same color and/or design as the screen print head 106 at the same indexing station 104 of the screen printing machine, or a different color and/or design. In one variation, the individual screen print head machine 1504 applies the same color at the station 104 but at a different pressure than the print head 106 of the screen printing machine 100. Another one of the printing units 1502 is a digital printer 1506, such as an inkjet or thermal printer, that is able to customize the garment, if desired. For instance, the digital printer 1506 can be used to print an individual's name or favorite image onto a shirt.

As a result of continual use, the constant telescoping movement of the platen 102 may cause deterioration in print registry. In one design, the bearings 410 can includes guide rails that are constructed to resist wear and hold registry after continual use. In another design, less expensive slide mechanisms can be implemented in which the locking mechanism 404 incorporates an alignment mechanism, such as a v-shaped alignment notch, that is configured to hold registry when the platen 102 is locked in position via the locking mechanism 404.

As should be appreciated, the telescoping platen design described herein can be incorporated into other types of screen printing machines that are indexed in other ways besides rotating. For example, the platens 102 can be incorporated into oval, round, and/or linear indexing screen printing machines. By way of a nonlimiting example, the platens 102 can be incorporated into screen printing machines that all or in part indexed in a linear fashion. In this type of machine, the telescoping platen assembly 400 moves in a telescoping direction (i.e., extends or retracts) that is generally transverse to the indexing direction. While the screen printing machine was described above as having the platens raised so as to press against the screen printing units or other types of units at the individual stations, it should be recognized that the screen printing units or other units can be lowered towards the platens or both the screen printing units and the platens can move vertically so as to be pressed together. It further should be recognized that the above described screen printing machine and technique can be used to screen print on a variety of substrates beside garments or textiles, such as paper, plastics, etc.

While the platen rail 408 is depicted in the drawings as being located above the support rail 406, it should be recognized that the rails 406, 408 can be oriented in other manners. For instance, the support rail 406 can be located above the platen rail 408, and both rails can be oriented in a side-by-side fashion or even one inside the other. The rails 406, 408 can also be shaped differently than what is illustrated in the drawings. By way of non-limiting examples, the rails all or in part can be in the form of a round tube, circular tube, square tube, a hollow tube, and/or a solid beam. The platen arm assembly 400 can further include shock absorbers at one or both ends of the stroke. The locking mechanism 404 can also be configured differently than what is shown in the drawings. For example, the locking mechanism 404 can include frictional type locking mechanisms, such as clamping mechanisms that can hold the telescoping platen assembly 400 at fixed positions along a large range of potential locked positions. The locking mechanism 404 is depicted as locking the platen rail 408 at a single retracted position, but it is contemplated that the locking mechanism 404 can lock the platen rail 408 at more than one position and/or at other positions beside the retracted position. For instance, the locking mechanism 404 (or multiple locking devices 404) in another variation can lock the platen 102 at extended, neutral, and retracted positions. Moreover, the release device 412 as well as the automatic 414 and manual 416 releases can be configured differently. For example, the release device 412 can include a solenoid device or piston that pivots the latch 602. The manual release 414 can include a sensor and/or programmable logic in the control system of the machine 100, such as in a programmable logic controller (PLC), that controls the operation of the solenoid device or piston. The manual release 416 in this example can include an electric, pneumatic, or hydraulic powered button or lever that activates the solenoid device or piston. While the biasing mechanisms in the drawings are depicted as springs, it is envisioned that other types of biasing mechanisms, besides springs, can be used.

The automatic release 414 and the automatic actuator 418 can be configured differently than is shown in the drawings. For instance, the automatic release 414 can operate independently of the automatic actuator 418. While illustrated in some of the drawings as being located near the floor, the automatic release 414 and the automatic actuator 418 can be located elsewhere, such as incorporated into the body of the screen printing machine 100 so as to free up floor space. The automatic actuator 418 can include any number of mechanisms for extending the platen 102, such as a piston and/or wheel type device. One or more of the stations 104 can include the automatic actuator 418. In one example, only a single station 104 has the automatic actuator 418, and in another example, all of the stations 104 include an automatic actuator. The automatic release 414 and the automatic actuator 418 along with other components of the reciprocating platen design can be retrofitted into one or more stations of an existing screen printing machine so that the owner of the machine can gradually increase its capabilities or can be assembled into a new screen printing machine.

While the invention has been illustrated and described in detail in the drawings and foregoing description, the same is to be considered as illustrative and not restrictive in character, it being understood that only the preferred embodiment has been shown and described and that all changes, equivalents, and modifications that come within the spirit of the inventions defined by following claims are desired to be protected. All publications, patents, and patent applications cited in this specification are herein incorporated by reference as if each individual publication, patent, or patent application were specifically and individually indicated to be incorporated by reference and set forth in its entirety herein.

The invention claimed is:

1. A screen printing system, comprising:

a screen printing machine including a screen printing unit including a screen, and a platen arm assembly including a platen, a rail assembly configured to move the platen in a telescoping direction from at least a printing position where the platen is positioned under the screen for screen printing to an uncovered position where the platen is not covered by the screen, wherein the rail assembly includes a support rail secured to the screen printing machine, a platen rail secured to the platen, and one or more rail bearings disposed between the support rail and the platen rail, and a locking mechanism configured to lock the support rail with the platen rail when the platen is at least positioned at the printing position.

2. The system of claim 1, wherein the screen printing machine is configured to index the platen in an indexing direction that is transverse to the telescoping direction.

3. The system of claim 1, wherein:

the screen printing machine is configured to rotate the platen about a central axis; and the platen is configured to move in a radial direction relative to the central axis when moving in the telescoping direction.

4. The system of claim 3, wherein the uncovered position is located in the radial direction closer to the central axis than the printing position.

5. The system of claim 3, wherein the uncovered position is located in the radial direction farther away from the central axis than the printing position.

6. The system of claim 1, wherein the platen arm assembly further includes a release device configured to release the locking mechanism to allow the platen to move in the telescoping direction.

7. The system of claim 6, wherein the release device includes a manual release configured to allow an operator to manually release the locking mechanism.

8. The system of claim 6, wherein the release device includes an automatic release configured to allow the screen printing machine to automatically release the locking mechanism.

9. The system of claim 1, further comprising:

an automatic actuator configured to automatically move the platen from the printing position to the uncovered position.

10. The system of claim 9, wherein the screen printing machine further includes an automatic release configured to unlock the locking mechanism when the automatic actuator moves the platen.

11. The system of claim 1, further comprising:

a flash unit configured to flash the platen when at the uncovered position.

12. The system of claim 11, wherein the flash unit has a flash head configured to extend to cover at least part of the platen when at the uncovered position.

13. The system of claim 11, wherein the flash unit is positioned to cover at least part of the platen when at the uncovered position.

14. The system of claim 1, further comprising:

a print unit positioned to print when the platen is positioned at the uncovered position.

15. The system of claim 14, wherein the print unit includes an individual screen print head machine.

16. The system of claim 14, wherein the print unit includes a digital printer.

17. A screen printing system, comprising:

a screen printing machine including at least two stations, wherein at least one of the stations includes a screen printing head, wherein at least one of the two stations comprises a flash unit, a platen configured to index relative to the stations by rotating about an axis, the flash unit located radial outwards from the screen printing head, wherein the platen is configured to move in a radial outwards direction from a screen printing position where the platen is aligned with the screen printing head to a flashing position where the platen is aligned with the flash unit.

18. The system of claim 17, wherein the screen printing machine includes an automatic actuator configured to extend the platen in the radial outwards direction.

19. A method, comprising:

indexing a platen in an indexing direction to a station in a screen printing machine;

screen printing with a screen printing unit a layer of ink onto a substrate carried by the platen at the station, wherein the platen is located at a first position where the platen is covered by the screen printing unit during said screen printing;

moving the platen at the station in a horizontal direction that is transverse to the indexing direction from the first position to a second position where the platen is not covered by the screen printing unit;

flashing the layer of ink on the substrate at the second position after said moving; and moving the platen to the first position after said flashing.

20. The method of claim 19, further comprising:

cooling the layer of ink after said flashing by blowing air onto the layer of ink while the platen is at the second position.

21. The method of claim 19, further comprising:

screen printing a second layer of the ink onto the substrate with the screen printing unit after said moving the platen to the first position.

22. The method of claim 21, further comprising:

moving the platen to the second position after screen printing the second layer; and flashing the second layer of the ink while the platen is at the second position.

23. The method of claim 21, wherein said screen printing the second layer includes applying a printing pressure that is lower than during said screen printing the layer of the ink.

24. The method of claim 19, further comprising:

wherein said screen printing occurs before said moving; and inspecting the layer of ink on the substrate after said moving.

25. The method of claim 19, further comprising:

transferring a substrate to or from the platen after said moving.

26. The method claim 19, wherein said moving takes the platen out of production.

27. A screen printing system, comprising:

a screen printing machine including at least two stations, wherein at least one of the stations includes a first screen printing head, wherein at least one of the two stations comprises a second screen printing head, a platen configured to index relative to the stations by rotating about an axis, the second screen printing head located radial outwards from the first screen printing head, and wherein the platen is configured to move in a radial outwards direction from a first screen printing position where the platen is aligned with the first screen printing head to a second screen printing position where the platen is aligned with the second screen printing head.

* * * * *